US005482119A

United States Patent [19]

Manke et al.

[11] Patent Number: 5,482,119

[45] Date of Patent: Jan. 9, 1996

[54] MULTI-MODE WELL TOOL WITH HYDRAULIC BYPASS ASSEMBLY

[75] Inventors: Kevin R. Manke, Flower Mound; Curtis Wendler, Carrollton, both of Tex.

[73] Assignee: Halliburton Company, Houston, Tex.

[21] Appl. No.: 316,534

[22] Filed: Sep. 30, 1994

[51] Int. Cl.[6] ..... E21B 34/10

[52] U.S. Cl. ..... 166/374; 166/386; 166/321

[58] Field of Search ..... 166/321, 250, 166/336, 264, 324, 373, 374, 372, 386

[56] References Cited

U.S. PATENT DOCUMENTS

| | | | |
|---|---|---|---|
| 3,856,085 | 12/1974 | Holden et al. | 166/264 |
| 4,355,685 | 10/1982 | Beck | 166/240 |
| 4,422,506 | 12/1983 | Beck | 166/324 |
| 4,429,748 | 2/1984 | Beck | 166/324 |
| 4,489,786 | 12/1984 | Beck | 166/374 |
| 4,515,219 | 5/1985 | Beck | 166/374 |
| 4,537,258 | 8/1985 | Beck | 166/374 |
| 4,557,333 | 12/1985 | Beck | 166/374 |
| 4,633,952 | 1/1987 | Ringgenberg | 166/336 |
| 4,646,838 | 3/1987 | Manke | 166/321 |
| 4,667,743 | 5/1987 | Ringgenberg et al. | 166/321 |
| 4,711,305 | 12/1987 | Ringgenberg | 166/336 |
| 4,736,798 | 4/1988 | Zunkel | 166/321 |
| 5,050,681 | 9/1991 | Skinner | 166/374 |
| 5,180,015 | 1/1993 | Ringgenberg et al. | 166/386 |
| 5,273,112 | 12/1993 | Schultz | 166/374 |
| 5,335,731 | 8/1994 | Ringgenberg et al. | 166/336 |
| 5,355,960 | 10/1994 | Schultz et al. | 166/374 |

*Primary Examiner*—Frank S. Tsay
*Attorney, Agent, or Firm*—Shawn Hunter; William Imwalle

[57] ABSTRACT

An annulus pressure responsive tool of the type which contains lateral circulation ports and a ball valve, each operable between open and closed positions to configure the tool into different modes of operation. These modes include a well test position in which the ball valve is open and the circulation ports are closed, a blank position in which the ball valve and circulation ports are both closed, and a circulating position in which the ball valve is closed and the circulating ports are open. Through manipulation of annulus pressure, the tool mode can be changed during the annulus pressure release to move out of the well test position and into the blank and circulating positions. An operating mandrel assembly is slidably disposed within the exterior housing of the tool and its movement dictates the positions of both the circulation ports and the ball valve. The operating mandrel is moveable by means of an annulus pressure conducting channel which is capable of receiving:, storing and releasing annulus pressure increases. A ratchet assembly associates the operating mandrel assembly and housing and functions as an overrideable position controller to dictate response of the operating mandrel assembly to annulus pressure changes.

20 Claims, 32 Drawing Sheets

MULTI-MODE WELL TOOL WITH HYDRAULIC BYPASS ASSEMBLY

BACKGROUND OF THE INVENTION

1. Field of the Invention

The present invention relates to multi-mode testing tools which are operable in several modes such as a drill-pipe tester, formation tester, circulation valve and displacement valve.

2. Description of the Related Art

In oil and gas wells, it is common to conduct well testing and stimulation operations to determine production potential and enhance that potential. Annulus pressure responsive downhole tools have been developed which operate responsive to pressure changes in the annulus between the testing string and the well bore casing and can sample formation fluids for testing or circulating fluids therethrough. These tools typically incorporate both a ball valve and lateral circulation ports. Both the ball valve and circulation ports are operable between open and closed positions. A tool of this type is described in U.S. Pat. No. 4,633,952 issued to Ringgenberg and assigned to Halliburton Company. A commercially available multi-mode testing tool of this type is the "Omni SandGuard IV Circulating Valve". The tool is capable of performing in different modes of operation as a drill pipe tester valve, a circulation valve and a formation tester valve, as well as providing its operator with the ability to displace fluids in the pipe string above the tool with nitrogen or another gas prior to testing or retesting. A popular method of employing the circulating valve is to dispose it within a well bore and maintain it in a well test position during flow periods with the ball valve open and the circulation ports closed. At the conclusion of the flow periods, the tool is moved to a circulating position with the ports open and the valve closed. The tool is operated by a ball and slot type ratchet mechanism which provides opening and closing of the valve responsive to a series of annulus pressure increases and decreases. Unfortunately, the changing between ,tool modes in the present tool is limited in that the ratchet dictates preprogrammed steps for changing the tool between its different positions. An operator must follow each of the preprogrammed steps to move the tool between positions. A standard circulating valve ratchet, for instance, requires 15 cycles of pressurization and depressurization in the annulus to move the tool out of the well test position, into the circulating position and back again. This process requires approximately one hour.

It would be desirable, therefore, to employ a tool which will allow an operator to shift the tool from a well test position to a circulating position with a minimum of pressure cycles. An operator would be able to maintain his tool in the well test position and close the tool when desired without following a preprogrammed cycle schedule. The number and times of closures could be orchestrated in accordance with programs established by reservoir engineers or supervisors.

SUMMARY OF THE INVENTION

An improved annulus pressure responsive tool is described of the type which contains lateral circulation ports and a ball valve, each of which are operable between open and closed positions to configure the tool into different modes of operation. These modes include a well test position in which the ball valve is open and the circulation ports are closed, a blank position in which the ball valve and circulation ports are both closed, and a circulating position in which the ball valve is closed and the circulation ports are open. Through manipulation of annulus pressure, the tool mode can be changed upon reduction or release of annulus pressure to move the tool out of the well test position and into the blank and circulating positions.

An operating mandrel assembly is slidably disposed within the exterior housing of the tool whose movement dictates the positions of both the circulation ports and the ball valve. The operating mandrel is moveable by means of an annulus pressure conducting channel which is capable of receiving, storing and releasing annulus pressure increases. A ratchet assembly associates the operating mandrel assembly and housing and functions as an overrideable position controller which dictates response and movement of the operating mandrel assembly to annulus pressure changes. The ratchet assembly contains a pair of ratchet balls which travel in ratchet slots on a ratchet slot sleeve. The ratchet slots feature a well test travel path within which the ratchet balls are maintained during normal operation of the tool in its well test position. A secondary ratchet path is contiguous to the well test path. The ratchet balls may be redirected into the secondary ratchet path and moved to ratchet ball positions which permit the operating mandrel assembly to be moved to positions corresponding to blank and circulating modes for the tool.

A fluid metering assembly is featured which includes upward and downward fluid paths for flow during annulus pressure changes. The upward flow path towards the fluid spring during annulus pressurization permits relatively unrestricted fluid flow. The downward flow path away from the fluid spring during a release of annulus pressure provides metered flow to provide an operator sufficient time to generate an annulus pressure increase to move the ratchet balls out of the well test travel path and into the secondary path.

A hydraulic bypass assembly is included which selectively reduces the time required for portions of the metered transmission of stored fluid pressure away from the fluid spring. The bypass assembly includes a bypass mandrel and associated fluid communication bypass grooves which increase the flow of fluid away from the fluid spring and toward the ratchet assembly during portions of the pressure release operation.

DETAILED DESCRIPTION OF PREFERRED EMBODIMENTS

Figure 1:
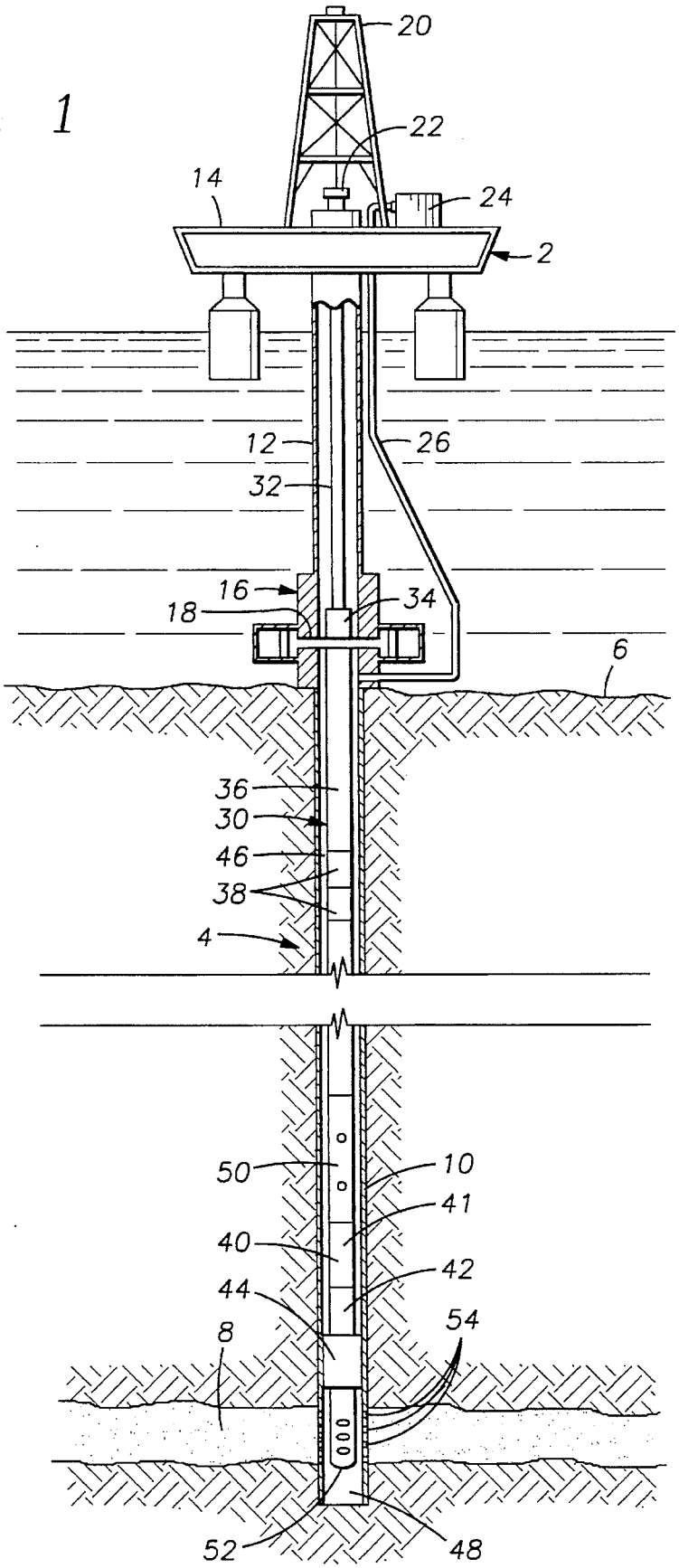
FIG. 1 provides a schematic vertical section view of a representative offshore well with a platform from which testing may be conducted and illustrates a formation testing string or tool assembly in a submerged well bore at the lower end of a string of drill pipe which extends upward to the platform.

Referring to FIG. 1, the present invention is shown schematically incorporated in a testing string deployed in an offshore oil or gas well. Platform 2 is shown positioned over a submerged oil or gas well bore 4 located in the sea floor 6, well bore 4 penetrating potential producing formation 8. Well bore 4 is shown to be lined with steel casing 10, which is cemented into place. A subsea conduit or riser 12 extends from the deck 14 of platform 2 to a subsea wellhead 16, which includes a blowout preventer 18. Platform 2 supports a derrick 20 thereon, as well as a hoisting apparatus 22, and a pump 24 which communicates with the well bore 4 via control conduit 26, which extends to annulus 46 below blowout preventer 18.

A testing string 30 is shown disposed in well bore 4, with blowout preventer 18 closed thereabout. Testing string 30 includes an upper drill pipe string 32 which extends downward from platform 2 to wellhead 16, whereat is located a hydraulically operated "test tree" 34, below which extends intermediate pipe string 36. Slip joint 38 may be included in string 36 to compensate for vertical motion imparted to platform 2 by wave action; slip joint 38 may be similar to that disclosed in U.S. Pat. No. 3,354,950 to Hyde. Below slip joint 38, intermediate string 36 extends downwardly to a multi-mode testing tool 50 of the present invention. Below multi-mode tool 50 is a lower pipe string 40, extending to a tubing seal assembly 42, which stabs into a packer 44. Above the tubing seal assembly 42 on the lower pipe string 40 is a tester valve 41 which may be of any suitable type known in the art. When set, packer 44 isolates upper well bore annulus 46 from lower well bore 48. Packer 44 may be any suitable packer well known in the art, such as, for example, a Baker Oil Tool Model D packer, an Otis Engineering Corporation Type W packer, or Halliburton Services "CHAMP®", "RTTS", or "EZDRILL® SV" packers. Tubing seal assembly 42 permits testing string 30 to communicate with lower well bore: 48 through a perforated tail pipe 52. In this manner, formation fluids from formation 8 may enter lower well bore 48 through the perforations 54 in casing 10, and flow into testing string 30.

After packer 44 is set in well bore 4, a formation test for testing the production potential of formation 8 may be conducted by controlling the flow of fluid from formation 8 through testing string 30 using variations in pressure to operate tool 50. The pressure variations are effected in upper annulus 46 by pump 24 and control conduit 26, utilizing associated relief valves (not shown). Prior to the actual test, however, the pressure integrity of testing string 30 may be tested with the valve ball of the multi-mode tool 50 closed in the tool's drill pipe tester mode. Tool 50 may be run into well bore 4 in its drill pipe tester mode, or it may be run in its circulation valve mode to automatically fill with fluid, and be cycled to its drill pipe mode thereafter. As the ball valve in tool 50 of the present invention is opened and closed in its formation tester valve mode, formation pressure, temperature, and recovery time may be measured during the flow test through the use of instruments incorporated in testing string 30 as known in the art. Such instruments are well known in the art, and include both Bourdon tube-type mechanical gauges, electronic memory gauges, and sensors run on wireline from platform 2 inside testing string 30 prior to the test. If the formation to be tested is suspected to be weak and easily damageable by the hydrostatic head of fluid in testing string 30, tool 50 may be cycled to its displacement mode and nitrogen or other inert gas under pressure employed to displace fluids from the string prior to testing or retesting.

It may also be desirable to treat the formation 8 in conjunction with the testing program while testing string 30 is in place. Treatment programs may include hydraulically fracturing the formation or acidizing the formation. Such a treatment program is conducted by pumping various chemicals and other materials down the flow bore of testing string 30 at a pressure sufficient to force the chemicals and other materials into the formation. The chemicals, materials, and pressures employed will vary depending on the formation characteristics and the desired changes thought to be effective in enhancing formation productivity. In this manner, it is possible to conduct a testing program to determine treatment effectiveness without removal of testing string 30. If desired, treating chemicals may be spotted into testing string 30 from the surface by placing tool 50 in its circulation valve mode, and displacing string fluids into the annulus prior to opening the valve ball in tool 50.

At the end of the testing and treating programs, the circulation valve mode of tool 50 is employed, the circulation valve opened, and formation fluids, chemicals and other injected materials in testing string 30 circulated from the interior of testing string 30 are pumped back up the testing string 30 using a clean fluid. Packer 44 is then released (or tubing seal 42 withdrawn if packer 44 is to remain in place) and testing string 30 withdrawn from well bore 4.

FIGS. 2A–2J illustrate a well tool 50 which is similar in some respects to that described in U.S. Pat. No. 4,633,952 issued to Ringgenberg and assigned to the assignee of the present invention and which is incorporated herein by reference. Tool 50 is shown in section, enclosing a central flow conducting passage 56. As may be appreciated by reference to the drawings, connections of components are often complimented by the use of O-rings or other conventional seals. The use of such seals is well known in the art and, therefore, will not be discussed in detail. Commencing at the top of the tool 50, upper adapter 100 has threads 102 therein at its upper end, whereby tool 50 is secured to drill pipe in the testing string 30. Upper adapter 100 is secured to nitrogen valve housing 104 at threaded connection 106. Housing 104 contains a valve assembly (not shown), such as is well known in the art, and a lateral bore 108 in the wall thereof, communicating with downwardly extending longitudinal nitrogen charging channel 110.

Valve housing 104 is secured by threaded connection 112 at its outer lower end to tubular pressure case 114, and by threaded connection 116 at its inner lower end to gas chamber mandrel 118. Case 114 and mandrel 118 define a pressurized gas chamber 120 and an upper oil chamber 122, the two being separated by a floating annular piston 124. Channel 110 is in communication with chamber 120.

The upper end of oil channel coupling 126 extends between case 114 and gas chamber mandrel 118, and is secured to the lower end of case 114 at threaded connection 128. A plurality of longitudinal oil channels 130 spaced around the circumference of coupling 126 (one shown), extend from the upper terminal end of coupling 126 to the lower terminal end thereof. Radially drilled oil fill ports 132 extend from the exterior of tool 50, intersecting with channels 130 and closed with plugs 134. The lower end of coupling 126, includes a downwardly facing lower side 127 and is secured at threaded connection 140 to the upper end of connector housing 123.

Connector housing 123 is connected at its lower portion by threaded connection 125 to the fluid metering assembly 142 which is constructed primarily of upper and lower fluid flow housings 144 and 146 and a metering nut 148. While an exemplary construction for the fluid metering assembly 142 is described herein, it is understood that other constructions which perform these functions may also be used.

The upper fluid flow housing 144 is connected at its lower portion by threaded connection 154 to the lower fluid flow housing 146 which is, in turn, connected at thread 156 to ratchet case 158, with oil fill ports 160 extending through the wall of case 158 and closed by plugs 162. Ratchet case 158 presents an inwardly projecting, upwardly facing annular shoulder 164 (see FIG. 2D) on its inner surface which forms and separates an upper expanded bore 166 from a lower reduced diameter bore 168 below. The expanded bore 166 defines a ratchet chamber 170.

Figure 2A:
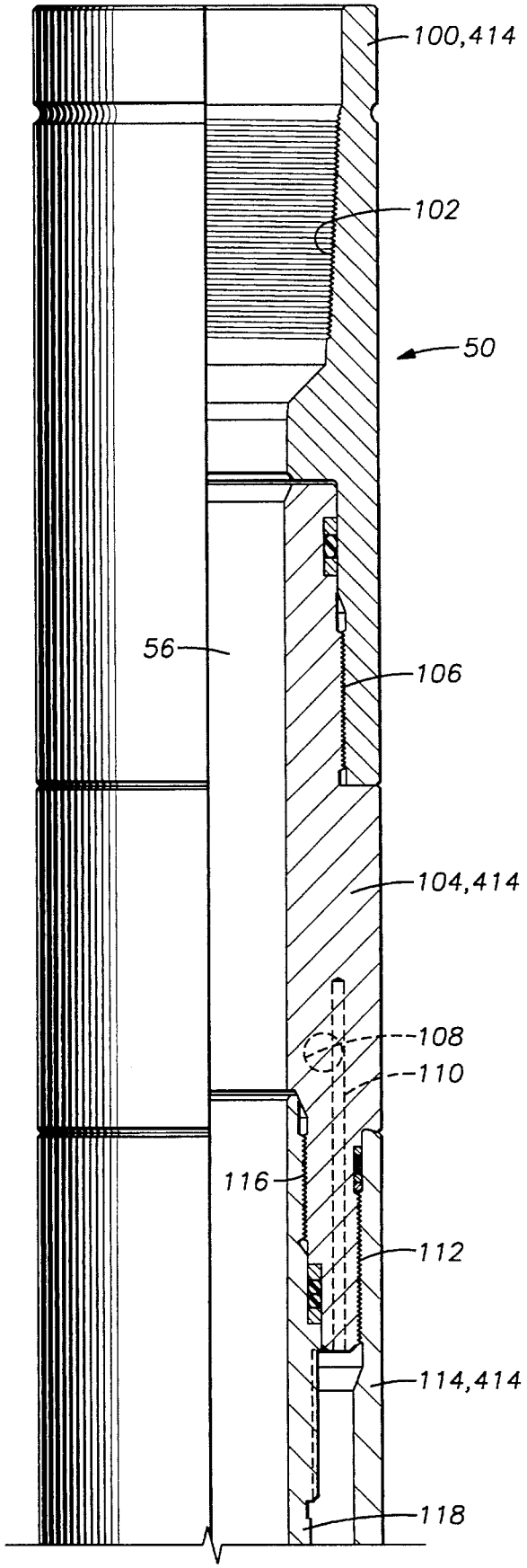
FIGS. 2A–2J are a vertical half section of an exemplary tool of the present invention in a well test mode.
Figure 2B:
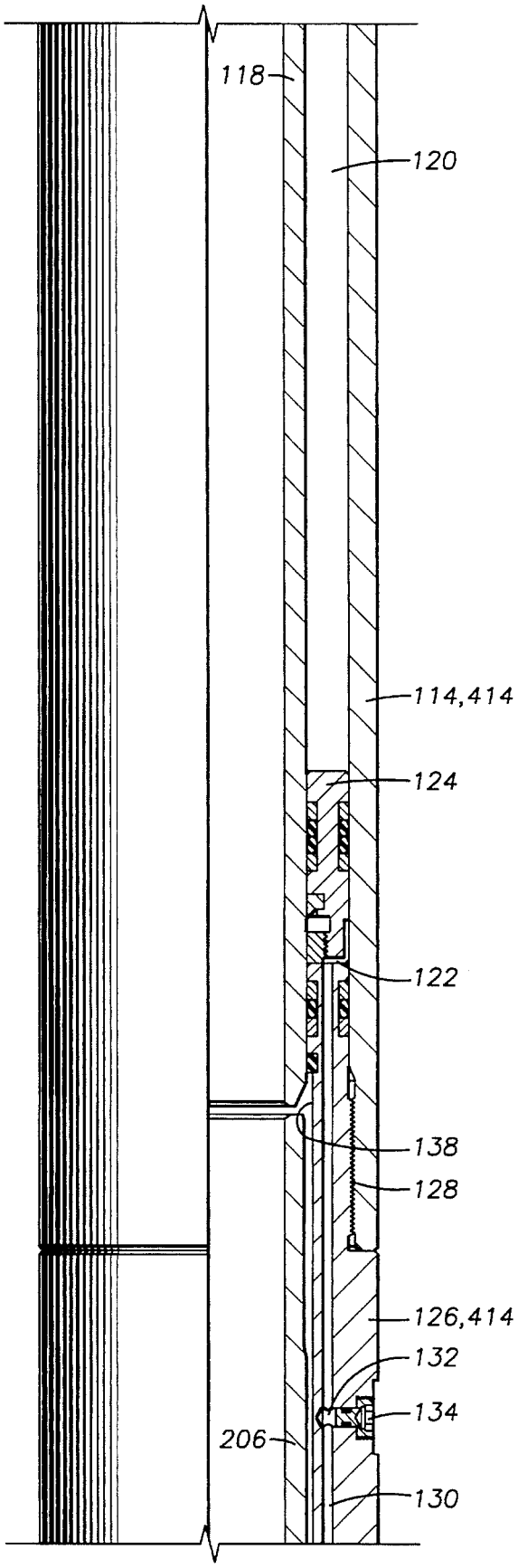
Figure 2C:
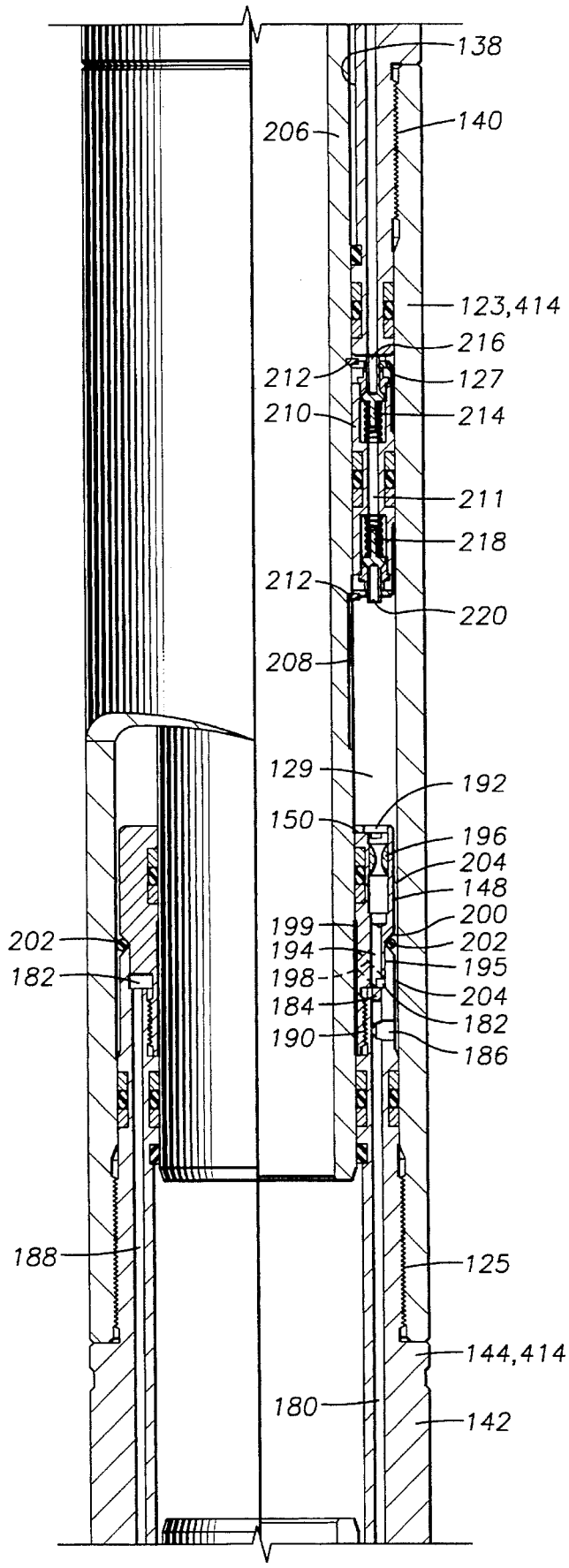

Referring now to FIG. 2C, the lower portion of the metering nut 148 is engaged at threads 190 to the upper fluid flow housing 144. The metering nut 148 includes an upward facing port 192 communicating with a bore 194 extending downwardly in nut 148. A fluid restrictor 196 is disposed within the bore 194. A radially inward facing lateral hole 198 in the metering nut 148 permits fluid communication radially inward between the annular gap 182 and the inner radial separation or clearance 199 between the metering nut 148 and the bypass mandrel 206. When connected, metering nut 148 and upper fluid flow housing 144, form an external annular groove 200 having a V-shaped cross-section. Between the upper portion of the metering nut 148 and the upper fluid flow housing 148 lies fluid passage 195 which extends between the groove 200 above and upper annular gap 182 below. An elastomeric O-ring 202 is seated within the groove 200 so as to block fluid entry into the groove 200 and between the two pieces, but the O-ring 202 may be urged radially outward by fluid pressure to permit fluid communication from the passage 195 outward through the groove 200. A radial separation or clearance 204 is present between the metering nut 148 and connector housing 123.

The lower fluid flow housing 146 includes a pair of longitudinal passages 172 which communicates fluid between ratchet chamber 170 below and a lower annular gap 176 above defined at the connection of upper fluid flow housing 144 and lower fluid flow housing 146.

Figure 2D:
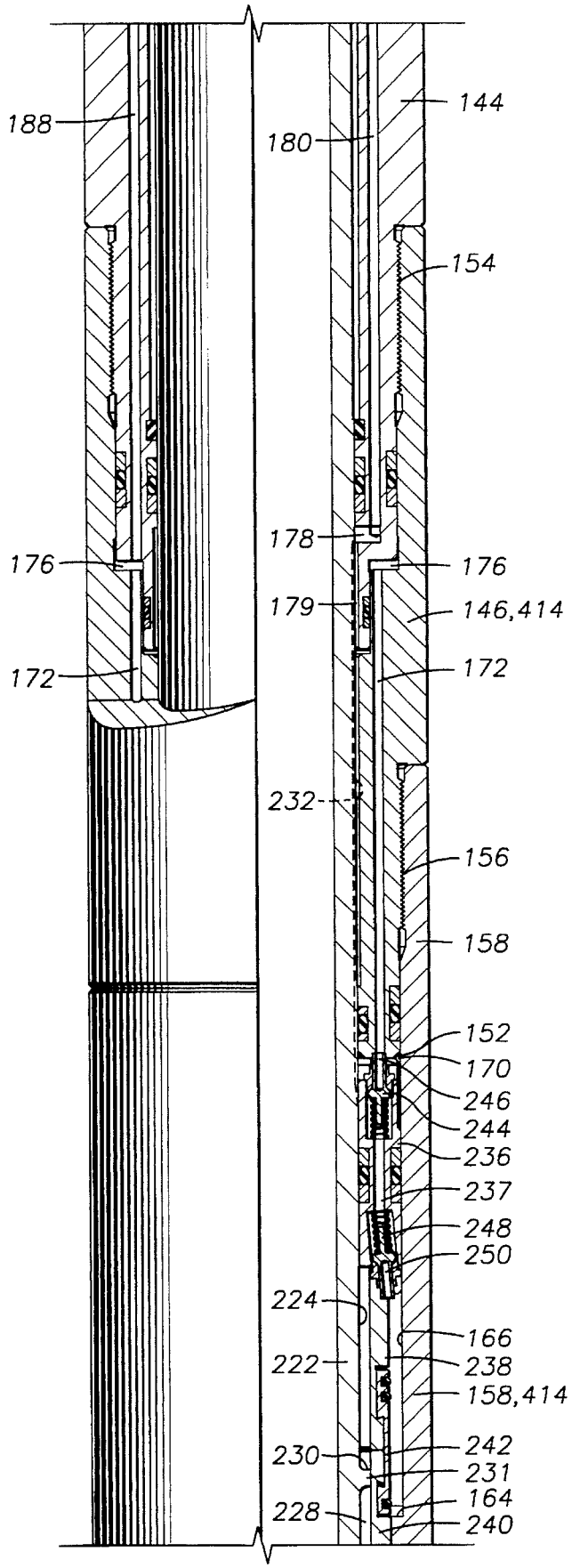

As depicted in FIG. 2D, on one radial side proximate its bottom portion, upper fluid flow housing 144 encases an inwardly opening non-annular cavity 178 and an adjoining annular chamber 179. The upper fluid flow housing 144 also encases a first passage 180 which runs between an upper annular gap 182 formed between metering nut 148 and upper fluid flow housing 144 and the non-annular cavity 178 below. A plug 184 is disposed within the first passage 180 just below the upper annular gap 182 so as to block fluid flow therethrough. A radially outward facing port 186 within the upper fluid flow housing 144 permits fluid communication between the first passage 180 and the radial clearance 204. A second passage 188 also communicates fluid between the lower annular gap 176 and upper annular gap 182 above.

A bypass mandrel 206 (FIGS. 2B–2C) is disposed within oil channel coupling 126, connector housing 123, and fluid metering assembly 142. A fluid chamber 129 is formed between mandrel 206 and housing 123 with coupling 126 at its upper end and metering assembly 142 at its lower end. One or more upper bypass grooves 208 are cut into the outer surface of bypass mandrel 206 such that, when the bypass mandrel is in its lower position fluid may be communicated along grooves 208 between fluid chamber 129 and lateral hole 198.

The fluid metering assembly 142 presents an upper end 150 and lower end 152. The fluid metering assembly 142 includes an upward flow path and a downward flow path for communication therebetween. The fluid metering assembly 142 is shown partially in full section in FIGS. 2C–2D to better demonstrate the upward and downward flow paths. In operation, the fluid metering assembly 142 permits relatively unrestricted upward movement of fluid through upward flow path 188, but will meter fluid downward over a period of time through the downward flow path.

When an upward pressure differential exists at the lower end 152 of assembly 142, the fluid metering assembly 142 provides an upward flow path which communicates fluid from the ratchet chamber 170 to fluid chamber 129 without presenting significant resistance. Traveling along the upward flow path, fluid enters passages 172 at lower end 152 and is communicated into the lower annular gap 176, then upward within the second passage 188 of upper fluid flow housing 144 to upper annular gap 182. Fluid then enters passage 195 and flows radially outward through the V-shaped groove 200, through the clearance 204 and into fluid chamber 129. Fluid will displace the O-ring 202 much more easily than it can pass through fluid restrictor 196, and flow past the O-ring 202 presents no significant restriction.

When a downward pressure differential exists at upper end 150, the fluid metering assembly 142 provides a downward flow path to communicate fluid downward from fluid chamber 129 to ratchet chamber 170. The downward flow path, unlike the upward path, provides flow resistance. By way of explaining the downward flow path, fluid movement within the metering assembly 142 is described as follows. Fluid first enters the radial clearance 204 surrounding the metering nut 148. Being blocked from entry into the groove 200 by the O-ring 202, the fluid passes further downward through the clearance 204 and enters the port 186 to move into and downward through the first passage 180 to the non-annular cavity 178 and non-annular chamber 179. As the fluid cannot progress beyond the non-annular gap and chamber 178 and 179, it must instead take an alternate path in which it passes downwardly through the upwardly facing port 192, bore 194 and fluid restrictor 196 to enter the upper annular gap 182 where it is transmitted to the second passage 188 of upper fluid flow housing 144 and downward to the lower annular gap 176 and can then move into ratchet chamber 170 through passages 172.

An annular piston 210 (FIG. 2C) is disposed within the fluid chamber 129 and affixed by lock rings 212 to bypass mandrel 206 to be axially moveable therewith. Piston 210 includes a longitudinal bore 211 therethrough having upper and lower enlarged diameter portions. An upper check valve 214 with an upwardly extending dart 216 within its upper end is disposed within the upper enlarged portion of bore 211. The upper check valve 214 is spring biased into a normally closed position which blocks upward fluid flow across it through the piston 210 but will permit downward fluid flow under pressure. Downward force upon the dart 216 will open the upper check valve to permit upward fluid flow therethrough. Lower check valve 218 is oppositely disposed from the upper check valve 214 within the lower enlarged portion of bore 211 of piston 210 and carries a downwardly extending dart 220 within its lower end. It is spring biased into a normally closed position against downward fluid flow, but will permit upward fluid flow under pressure. Upward force upon the dart 220 will open the lower check valve 218 to downward fluid flow therethrough.

The bypass mandrel 206 is axially slidable with respect to the oil channel coupling 126, housing 123, fluid chamber 129 and the fluid metering assembly 142 between an upper position proximate the lower end of gas chamber mandrel 118 and a lower position proximate the upper end of ratchet slot mandrel 222. Ratchet slot mandrel 222 extends upward from within ratchet case 158. The upper exterior 224 of ratchet slot mandrel 222 has a reduced, substantially uniform diameter, while the lower exterior 226 has a greater diameter so as to provide sufficient wall thickness for ratchet slots 228. Ratchet slot mandrel 222 includes an annular member 231 projecting radially outward and forming a piston seat 230 which faces upwardly and outwardly at the base of the upper exterior 224 of mandrel 222. There are preferably two such ratchet slots 228 extending longitudinally along the lower exterior of the ratchet slot mandrel 222.

The ratchet slot mandrel 222 is axially slidable within tool 50 between upper and lower positions as will be described in greater detail shortly. Lower longitudinal bypass grooves 232 are cut into the upper exterior 224 of ratchet slot mandrel 222. The grooves 232 should be of sufficient width to permit fluid flow therealong. The lower bypass grooves 232 generally adjoin the lower fluid flow housing 144 and should be in such a location and of such a length that when the ratchet slot mandrel 222 is in its upper positions, the grooves 232 are located alongside the lower fluid flow housing 146 and no fluid flow occurs along the grooves. As the ratchet slot mandrel 222 is moved toward its lower positions, the grooves 232 will be moved downward such that fluid communication may occur between the annular chamber 179 and the ratchet chamber 170.

A ball sleeve assembly 234 surrounds ratchet slot mandrel 222 and comprises shuttle piston 236, upper sleeve 238, lower sleeve 240 and clamp 242 which connects sleeves 238 and 240.

Shuttle piston 236 is constructed similarly in structure and function to annular piston 210 and is fixedly attached to or unitarily fashioned with upper sleeve 238. The shuttle piston 236 surrounds the upper exterior 224 of the ratchet slot mandrel 222 within the ratchet chamber 170. Shuttle piston 236 includes a longitudinal bore 237 therethrough having upper and lower enlarged diameter portions. An upper check valve 244 with upwardly extending dart 246 within its upper end is disposed in the upper enlarged portion, and lower check valve 248 with downwardly extending dart 250 within its lower end is disposed within the lower enlarged portion. The lower check valve 248 and dart 250 are shown as angled outwardly within the shuttle piston 236 such that the dart 250 contacts shoulder 164 when ball sleeve assembly 234 is moved downward within the ratchet case 158.

The lower end 252 of the ratchet slot mandrel 222 is secured at threaded connection 254 to extension mandrel 256. A radial clearance 258 is present between the radial exterior of lower end 252 and the interior surface of ratchet case 158. The lower end 260 of ratchet case 158 is secured at threaded connection 262 to extension case 264 which surrounds the extension mandrel 256. Annular intermediate oil chamber 266 is defined by ratchet case 158 and extension mandrel 256. The intermediate oil chamber 266 is connected by oil channels 268 to lower oil chamber 270. Annular floating piston 272 slidingly seals the bottom of lower oil chamber 270 and divides it from the lower wall fluid chamber 274 into which pressure ports 282 in the wall of case 264 open.

The general construction and operation of ratchet-type assemblies is well known in the art. Particular reference is made to U.S. Pat. No. 4,557,333 issued to Beck, U.S. Pat. No. 4,667,743 issued to Ringgenberg et al. and U.S. Pat. No. 4,537,258 issued to Beck, all of which are assigned to the assignee of the present invention and which are incorporated herein by reference. As will be appreciated by the discussion that follows, the tool 50 of the present invention incorporates a novel ratchet assembly having a dual-path ratchet slot within which a ratchet member is directed. The primary path is cyclical and maintains the tool's components in the well test mode. The secondary path is contiguous to the first path, and redirection of the ratchet member into the second path permits the tool's components to be altered so that the tool may be reconfigured into alternative modes of operation.

Figure 2E:
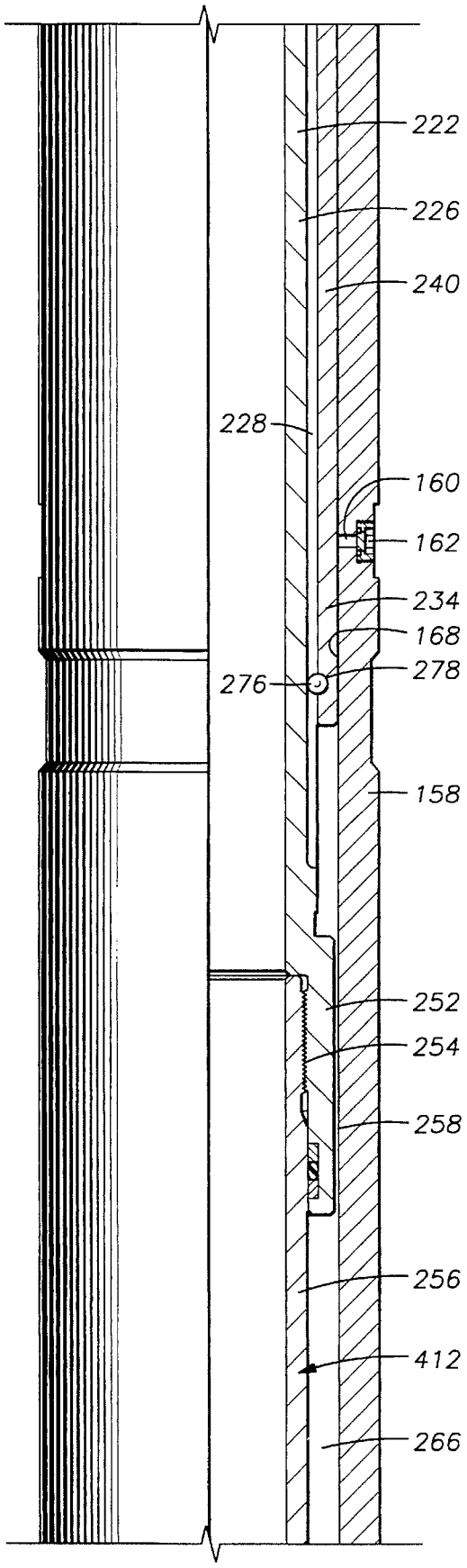
Figure 2F:
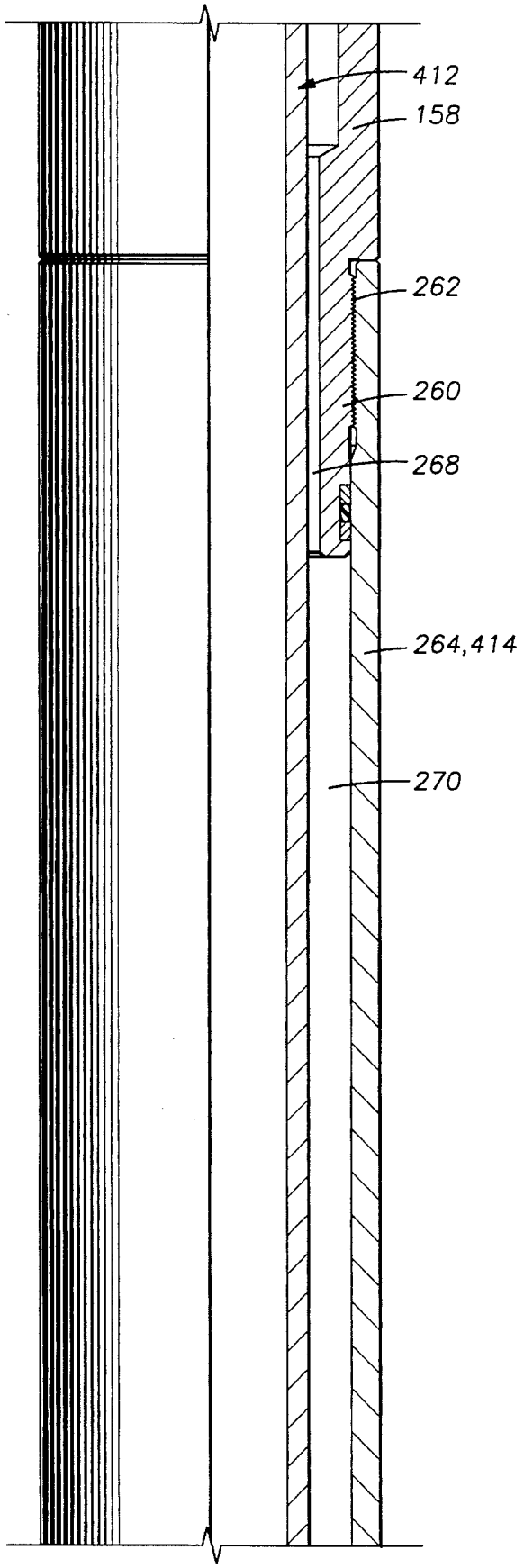
Figure 2G:
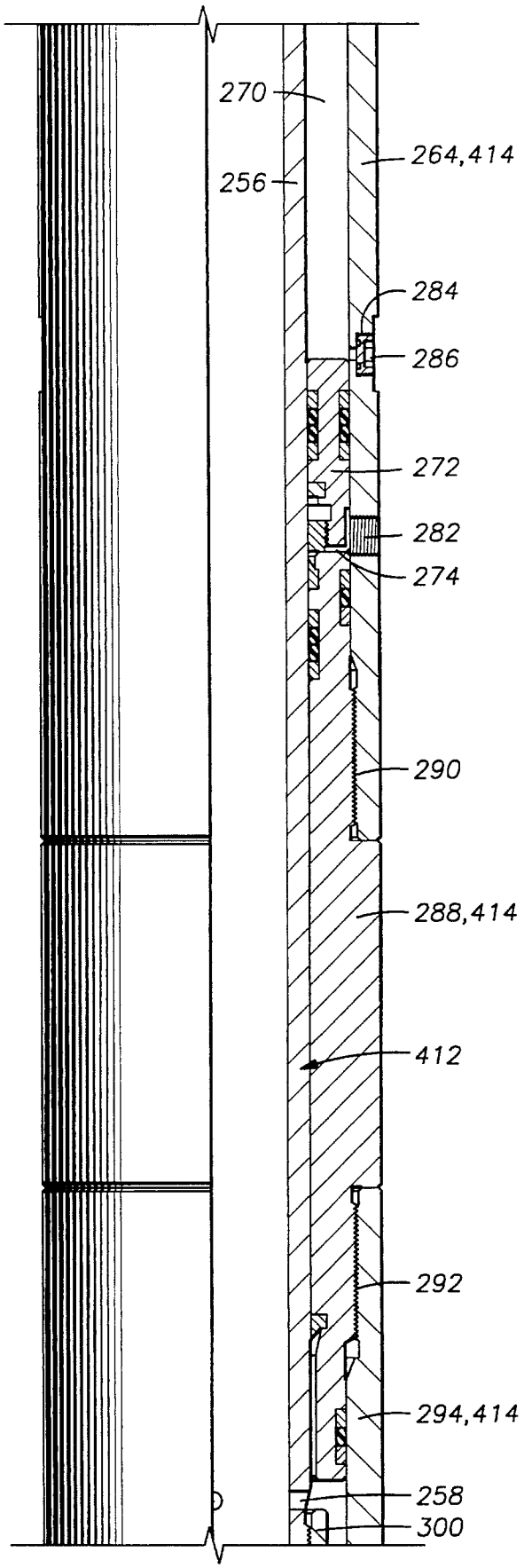
Figure 2H:
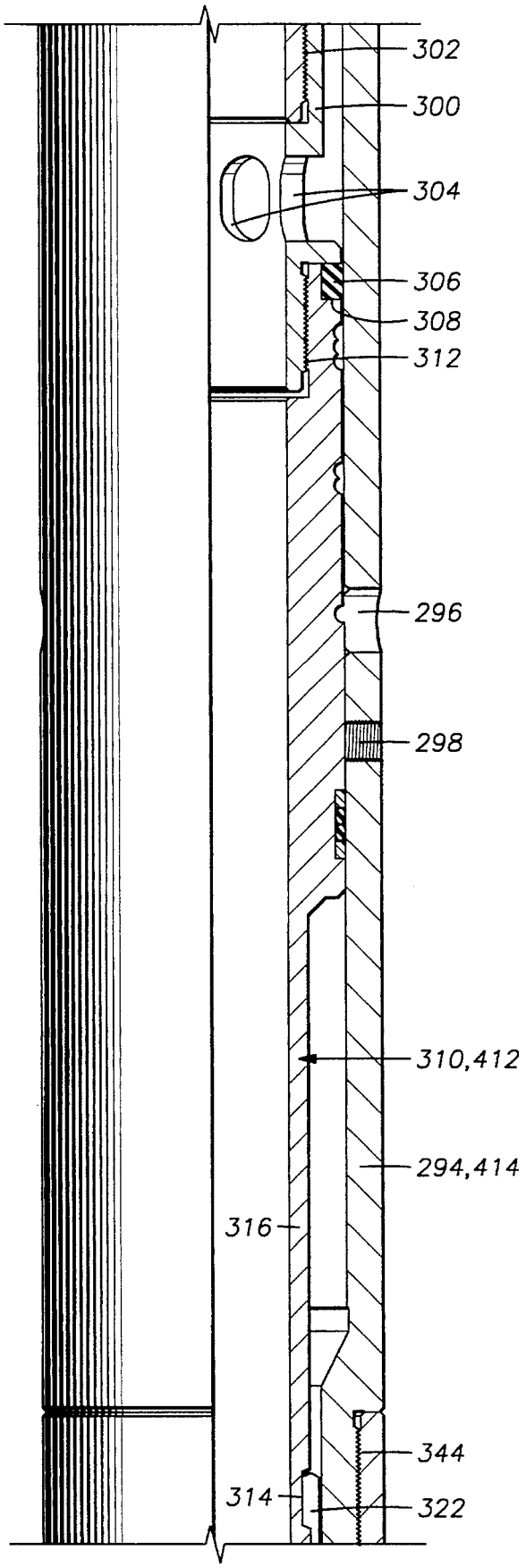
Figure 5:
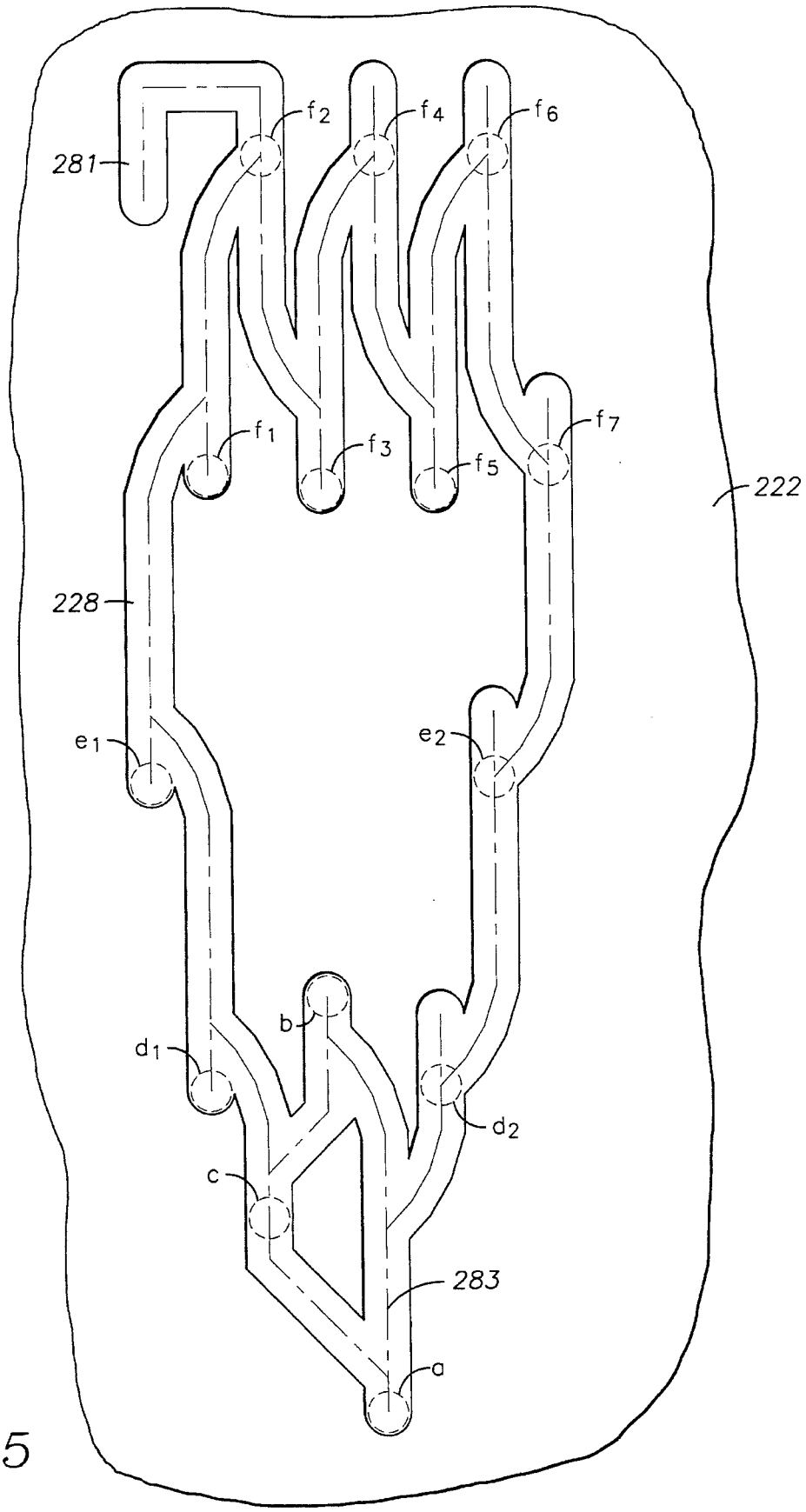
FIG. 5 illustrates a preferred slot design for a tool constructed in accordance with the present invention.

Referring now to FIGS. 2E and 5, two ratchet balls 276 are found in ball seats 278 located on diametrically opposite sides of lower sleeve 240 and each project into a ratchet slot 228 of semi-circular cross-section. The configuration of ratchet slot 228 is shown in FIG. 5. As shown there, the ratchet slot 228 includes an installation groove 281 which has a depth greater than that of the ratchet slot 228 to permit the introduction and capture of balls 276 during assembly of the tool 50. The ratchet slot 228 includes a unique pattern or configuration having a number of ball positions, a, b, c, $d_1$, $d_2$, $e_1$, $e_2$, $f_1$, $f_2$, $f_3$, $f_4$, $f_5$, $f_6$ and $f_7$ which are shown in phantom in FIG. 5. The ball positions correspond to the general positions for balls 276 along ratchet slot 228 during the various operations involving annulus pressurization changes. As the balls 276 follow the path of slot 228, lower sleeve 240 rotates with respect to upper sleeve 238, and axial movement of the ball sleeve assembly 234 is transmitted to ratchet slot mandrel 222 by balls 276.

Referring again to FIG. 2, the lower end of extension case 264 includes oil fill ports 284 containing closing plugs 286. A nipple 288 is threaded at 290 at its upper end to extension case 264 and at 292 at its lower end to circulation displacement housing 294. The circulation displacement housing 294 possesses a plurality of circumferentially spaced, radially extending circulation ports 296, as well as one or more pressure equalization ports 298, extending through the wall thereof. A circulation valve sleeve 300 is threaded to the lower end of extension mandrel 256 at threaded connection 302. Valve apertures 304 extend through the wall of circulation valve sleeve 300 and are isolated from circulation ports 296 by annular seal 306, which is disposed in seal recess 308 formed by the junction of circulation valve sleeve 300 and a lower operating mandrel 310, the two being threaded together at 312. Operating mandrel 310 includes a reduced diameter, downwardly extending skirt having an exterior annular recess 314.

A collet sleeve 318, having collet fingers 320 at its upper end extending upwardly therefrom, engages the downwardly extending skirt 316 of operating mandrel 310 through the accommodation of radially, inwardly extending protuberances 322 received by annular recess 314. As is readily noted in FIGS. 2H–2I, protuberances 322 and the upper portions of collet fingers 320 are confined between the exterior of mandrel 310 and the interior of circulation displacement housing 294 thereby maintaining the connection.

Collet sleeve 318 includes coupling 324 at its lower end comprising radially extending flanges 326 and 328, forming an exterior annular recess 330 therebetween. A lower coupling 332 comprises inwardly extending flanges 334 and 336 forming an interior recess 338 therebetween and two ball operating arms 338. Couplings 324 and 332 are maintained in engagement by their location in annular recess 340 between ball case 342, which is threaded at 344 to circulation-displacement housing 294, and ball housing 346. Ball housing 346 is of substantially tubular configuration, having an upper smaller diameter portion 348 and a lower, larger diameter portion 350. Larger diameter portion 350 has two windows 352 cut through the wall thereof to accommodate the inward protrusion of lugs 354 on each of the two ball operating arms 338. Windows 352 extend from shoulder 356 downward to shoulder 358 adjacent threaded connection 360 with ball support 362. On the exterior of the ball housing 346, two longitudinal channels (location shown by phantom arrow 364) of arcuate cross-section and circumferentially aligned with windows 352, extend from shoulder 366 downward to shoulder 356. Ball operating arms 338, which are of substantially the same arcuate cross section as channels 364 and lower portion 350 of ball housing 346, lie in channels 364 and across windows 352, and are maintained in place by the interior wail 368 of ball case 342 and the exterior of portion 350 of ball housing 346.

The interior of ball housing 346 possesses upper annular seat recess 370, within which annular ball seat 372 is disposed, being biased downwardly against ball 374 by ring spring 376. Surface 378 of upper seat 372 comprises a metal sealing surface, which provides a sliding seal with the exterior 380 of valve ball 374.

Valve ball 374 includes a diametrical bore 382 therethrough of substantially the same diameter as bore 384 of ball housing 346. Two lug recesses 386 extend from the exterior 380 of valve ball 374 to bore 382.

The upper end 388 of ball support 362 extends into ball housing 346, and carries lower ball recess 390 in which annular lower ball seat 392 is disposed. Lower ball seat 392 possesses arcuate metal sealing surface 394 which slidingly seals against the exterior 380 of valve ball 374. When ball housing 346 is made lap with ball support 362, upper and lower ball seats 372 and 392 are biased into sealing engagement with valve ball 374 by spring 376.

Exterior annular shoulder 396 on ball support 362 is contacted by the upper ends 398 of splines 400 on the exterior of ball case 342, whereby the assembly of ball housing 346, ball operating arms 338, valve ball 374, ball seats 372 and 392 and spring 376 are maintained in position inside of ball case 342. Splines 400 engage splines 402 on the exterior of ball support 362, and, thus, rotation of the ball support 362 and ball housing 346 within ball case 342 is prevented.

Lower adaptor 404 protrudes at its upper end 406 between ball case 342 and ball support 362, sealing therebetween, when made up with ball support 362 at threaded connection 408. The lower end of lower adaptor 404 carries on its exterior threads 410 for making up with portions of a test string below tool 50.

Figure 2I:
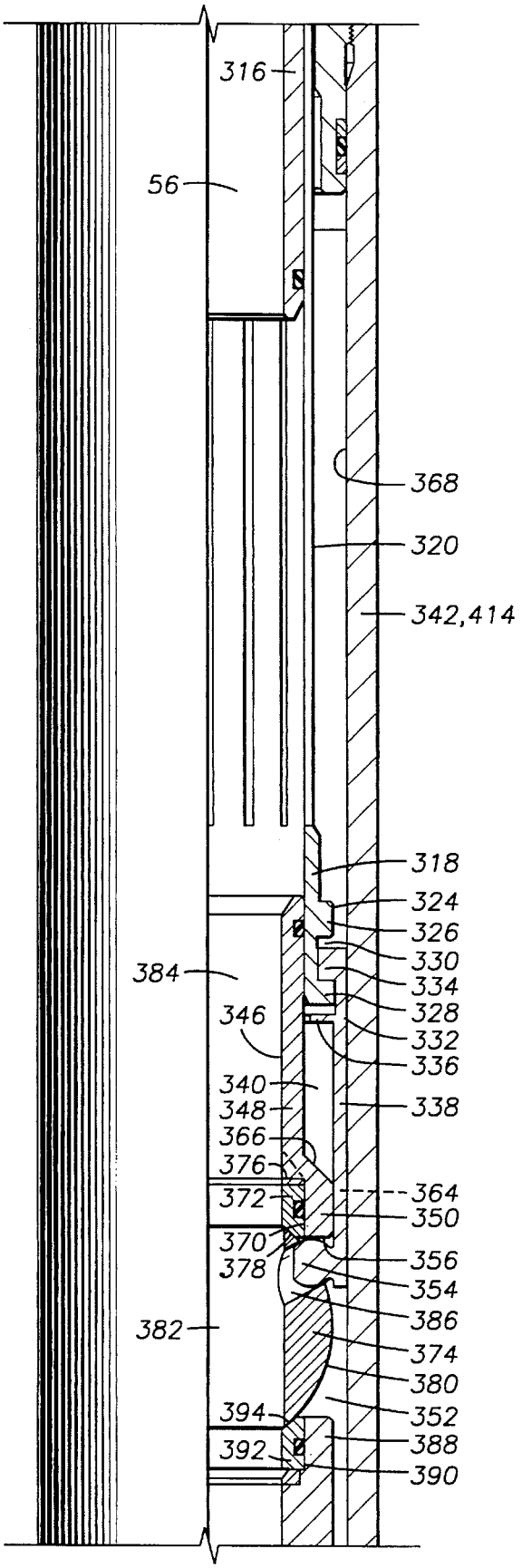
Figure 2J:
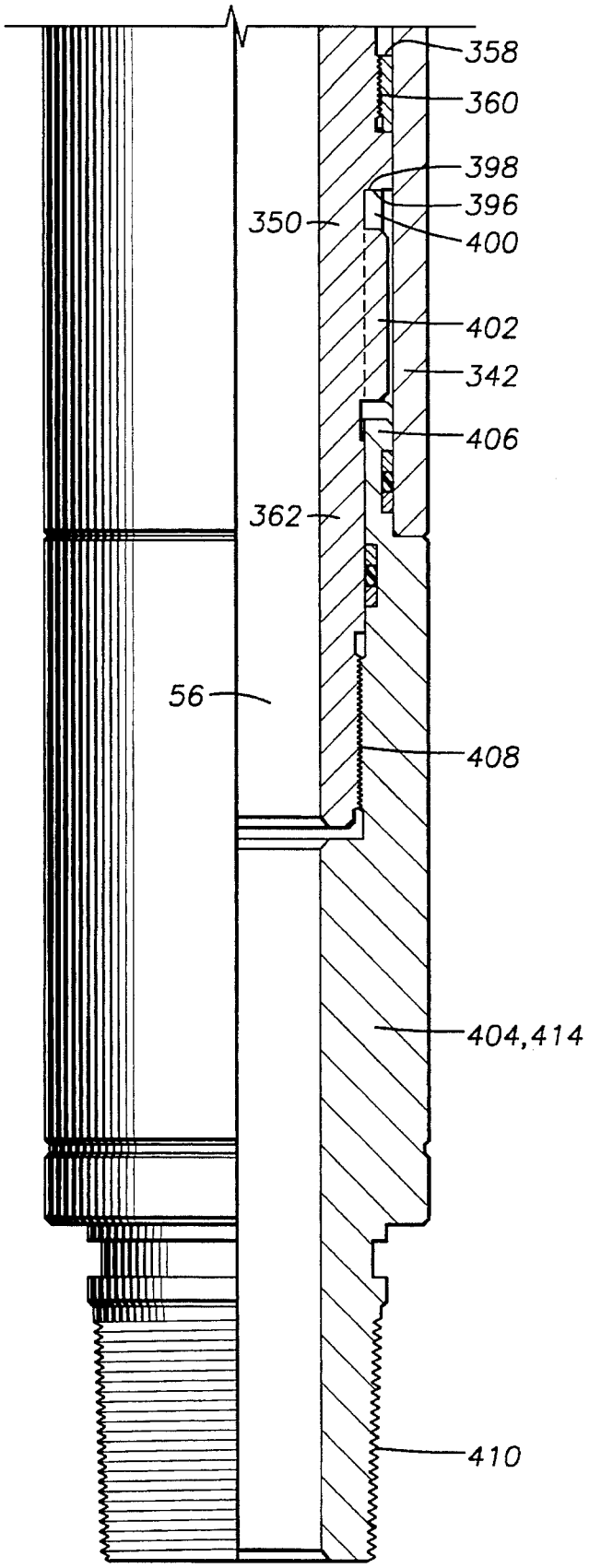

When valve ball 374 is in its open position, as shown in FIG. 2I, a "full open" conducting passage 56 extends throughout tool 50, providing an unimpeded path for formation fluids and/or for perforating guns, wireline instrumentation, etc.

It is noted that an exterior housing 414 for the tool 50 is made up of upper adapter 100, nitrogen valve housing 104, pressure, case 114, oil channel coupling 126, connector housing 123, upper and lower fluid flow housings 144 and 146, ratchet case 158, extension case 264, nipple 288, circulation displacement housing 294, ball case 342 and lower adaptor 404.

The ratchet slot mandrel 222, extension mandrel 256, circulation valve sleeve 300, operating mandrel 310 may be thought of as an operating mandrel assembly indicated generally at 412.

An annulus pressure conducting channel capable of receiving, storing and releasing annulus pressure increases is formed by pressure ports 282, fluid chamber 274, floating piston 272, lower oil chamber 270, oil channels 268, intermediate oil chamber 266, ball sleeve assembly 234, ratchet chamber 170, fluid metering assembly 142, fluid chamber 129, longitudinal oil channels 130, upper oil chamber 122, floating piston 124 and pressurized gas chamber 120. The pressurized gas chamber 120 functions as a fluid spring while the other components of the pressure conducting channel serve as a pressure conducting passage to communicate fluid pressure changes between the annulus 46 and the fluid spring.

The circulation valve sleeve 300, valve apertures 304, annular seal 306, circulation displacement housing 294 and circulation ports 296 may be thought of as a fluid circulating assembly 416 which may be selectively opened and closed to permit fluid flow between the annulus 46 and the central flow conducting passage 56 of the tool 50.

OPERATION OF THE PREFERRED EMBODIMENT OF THE PRESENT INVENTION

Referring to FIGS. 1–5, operation of the combination tool 50 of the present invention is described hereafter.

As tool 50 is run into the well in testing string 30, it is normally in its well test mode as shown in FIG. 2, with ball 374 in its open position and ball bore 382 aligned with tool bore 384. Circulation ports 296 are misaligned with circulation valve apertures 304, seal 306 preventing communication therebetween. With respect to FIG. 5, balls 276 will be proximately in position a in slot 228 as tool 50 is run into the well bore.

Operation of Tool 50 in the Well Test Position During Changes in Annulus Pressurization Pressure is increased in annulus 46 by pump 24 via control conduit 26. This increase in pressure is transmitted through pressure ports 282 (FIG. 2G) into well fluid chamber 274, where it acts upon the lower side of floating piston 272. Piston 272, in turn, acts upon a fluid, such as silicon oil, in lower chamber 270, which communicates via oil channels 268 with intermediate oil chamber 266. Fluid pressure in the intermediate oil chamber 266 flows around the lower end 252 of the ratchet slot mandrel 222 to exert upward fluid pressure upon the shuttle piston 236 which pulls ball sleeve assembly 234. Balls 276 move along slot 228 to position b. Via the association of the ratchet slot mandrel 222 and ball sleeve assembly 234, the ratchet slot mandrel 222 and the entire operating mandrel assembly 412 may be moved upward slightly but not a sufficient amount to affect either the valve ball 374 or the circulating assembly 416.

Fluid within ratchet chamber 170 is evacuated upward through the fluid metering assembly 142. By virtue of the upward flow path described above, the fluid is communicated into fluid chamber 129 without significant flow restriction. Annular piston 210 and the affixed bypass mandrel 206 are moved axially upward. Fluid above the piston 210 is evacuated upward from the fluid chamber 129 through longitudinal channels 130 into upper oil chamber 122 to urge floating piston 124 upward, thereby pressurizing the gas in chamber 120 to store the pressure increase.

As annulus pressure is subsequently bled off during depressurization, the pressurized nitrogen in chamber 120 pushes downward against floating piston 124 this pressure is transmitted through fluid within upper oil chamber 122, channels 130 and fluid chamber 129. Annular piston 210 and the affixed bypass mandrel 206 are moved axially downward. Fluid from chamber 129 is transmitted downward into the ratchet chamber 170 through the downward flow path of the fluid metering assembly 142. Ball sleeve assembly 234 is, therefore, biased downwardly with ratchet balls 276 following the paths of slot 228 past position c, where they shoulder at position a. Downward travel of the ball sleeve assembly 234 is limited by engagement of the shuttle piston 236 on piston seat 230 (FIG. 2D). Again, any downward movement of the ratchet slot mandrel 222 and the operating mandrel assembly 412 will be slight and not sufficient to close the valve ball 374 or close the circulating assembly 416. As a result, the ratchet assembly may be thought of as providing a default position sequence with the well test position cycle 283 wherein the operating mandrel assembly 412 is maintained during annulus pressure changes in primary mandrel positions such that the valve ball 374 and the circulating assembly 416 are not affected.

Operation of Tool 50 within a Well Bore

As tool 50 travels down to the level of the production formation 8 to be tested, at which position packer 44 is set, floating piston 272 moves upward under hydrostatic pressure, pushing ball sleeve assembly 234 upward and causing balls 276 to move toward position b. This movement does not change tool modes or open any valves. Upon tool 50 reaching formation 8, packer 44 is set. The aforesaid feature is advantageous in that it permits pressuring of the well bore annulus 46 to test the seal of packer 44 across the well bore 4 without closing valve ball 374. It also permits independent operation of other annulus pressure responsive tools within testing string 30.

Increases in annulus pressure will move floating piston 272 and ball sleeve assembly 234 further upward, its movement ultimately being restricted by the shouldering out of balls 276 at ball position b within slot 228. Reduction in annulus pressure will move floating piston 272 and ball sleeve assembly 234 downward and cause balls 276 to move downward proximate ball position c and ultimately back to ball position a. The well annulus pressure may be increased and decreased as many times as desired without moving the tool 50 out of the well test position, the balls 276 following the described well test position path 283, which is made up of the ball positions a, b and c and the paths of slot 228 connecting them. Effectively, the well test position path 283 affords default position control for the tool 50 by maintaining the tool 50 in its well test position during regular annulus pressurization cycles.

The tool 50 may be changed out of the well test position by increasing annulus pressure during the portion of the annulus pressure reduction sequence when balls 276 are proximate ball position c. As a result, annulus repressurization during a release of stored fluid pressure from the pressurized gas chamber 120 acts to override the default position control being provided for the operating mandrel assembly 222 by the well test position path 283. Fluid restriction provided by passage of fluid through the downward flow path in the fluid metering assembly 142 will provide a sufficiently metered downstroke so that an operator will have time to repressurize the annulus. It is expected that the time required for the ball sleeve assembly 234 to move fully downward so that the balls 276 essentially return to ball position a is approximately 10 minutes; the time required for the balls 276 to move only to position c is approximately 4 minutes. It should be apparent to one skilled in the art that the ratchet slot 228 and well test position path 283 might be altered such that the balls 276 are directed out of the well test position path 283 by an annulus pressure reduction which occurs during an increase of stored fluid pressure in the pressurized gas chamber 120.

Figure 3A:
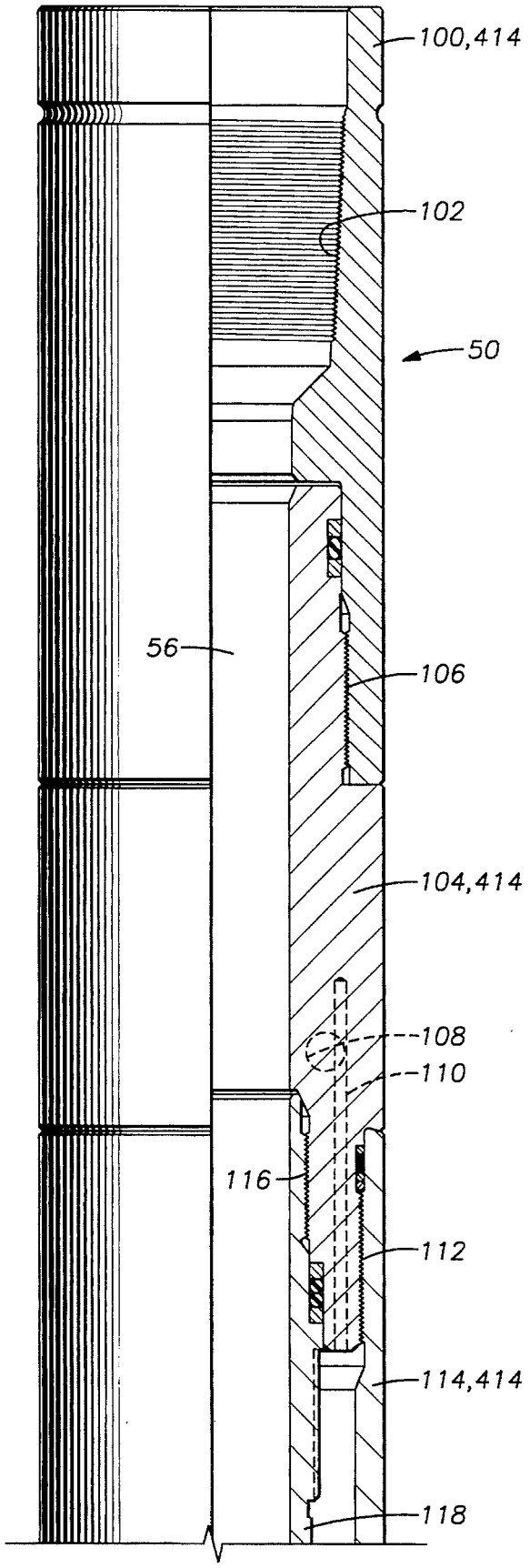
FIGS. 3A–3J are a vertical half-section of the tool of FIG. 2 in a blank mode.
Figure 3B:
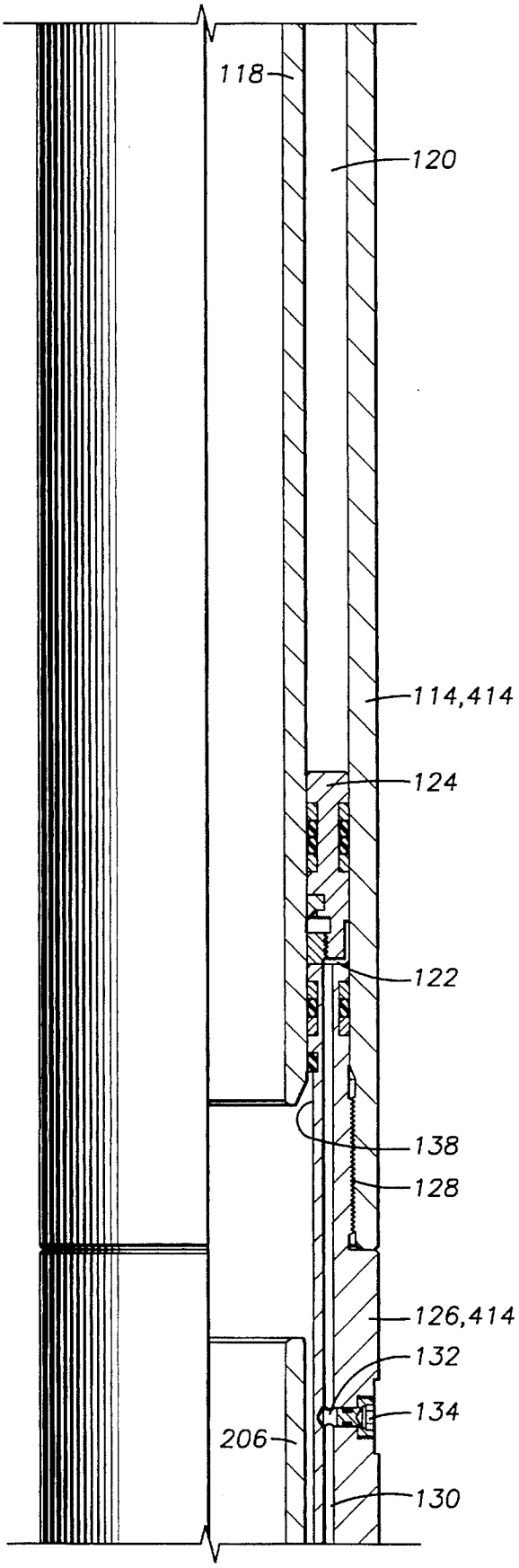
Figure 3C:
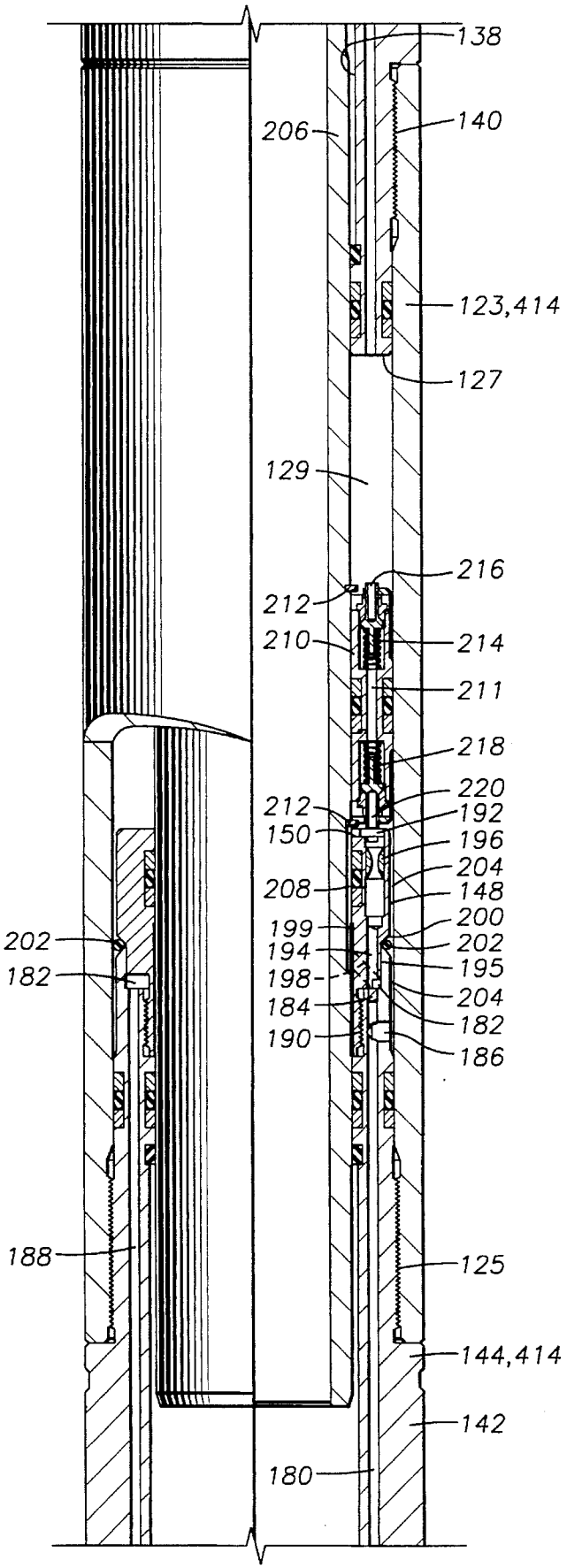
Figure 3D:
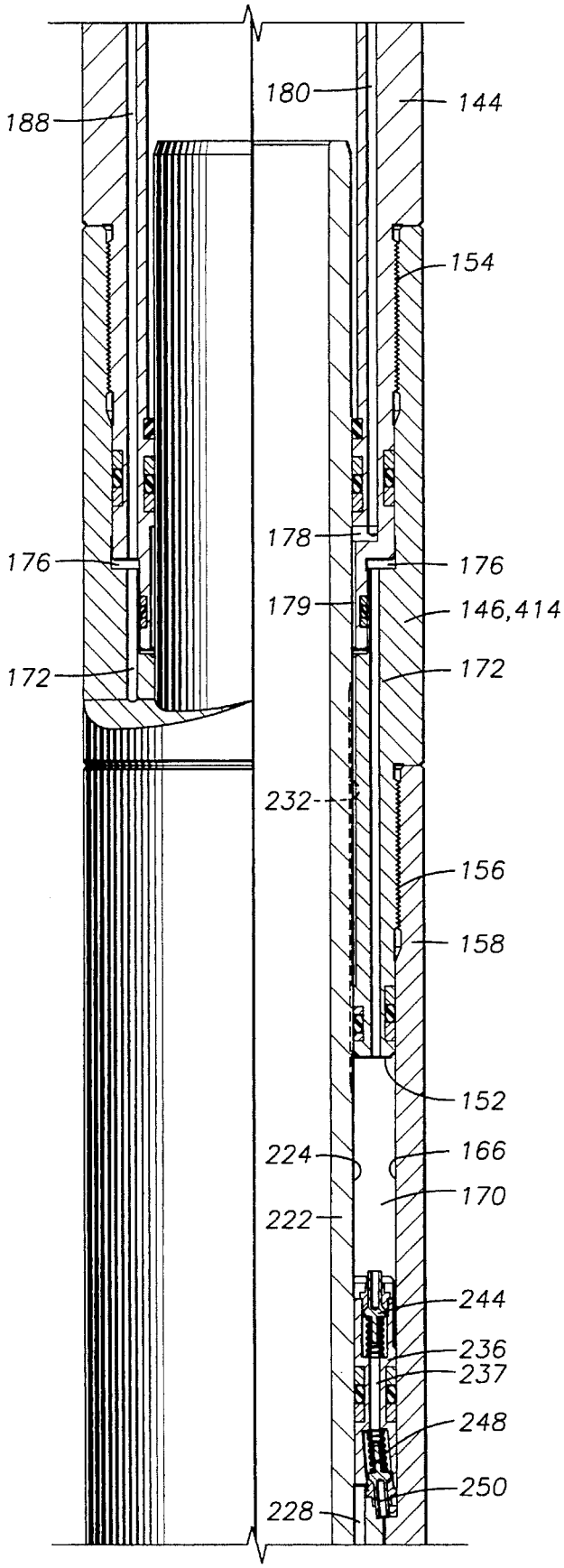
Figure 3E:
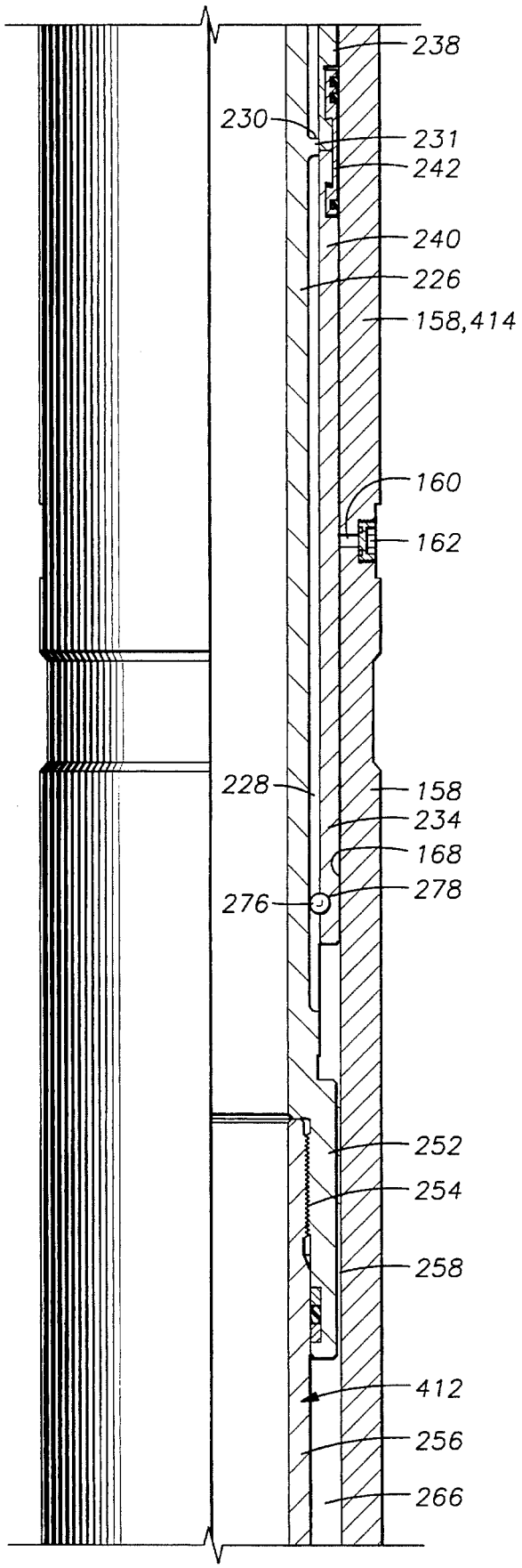
Figure 3F:
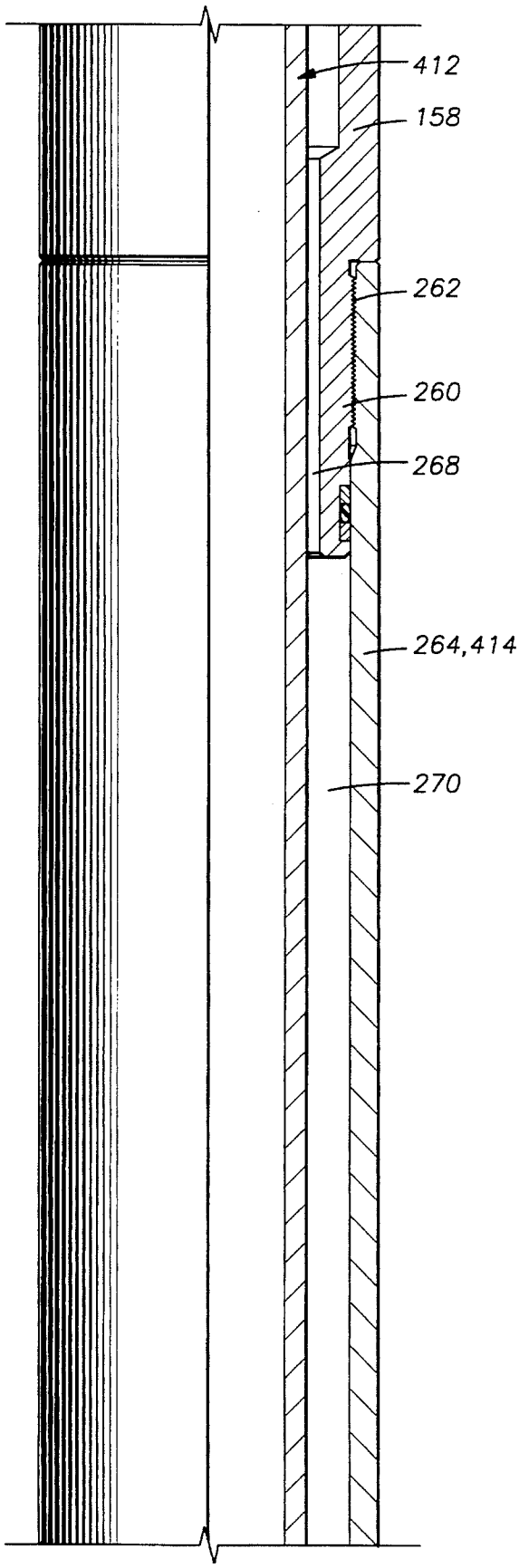
Figure 3G:
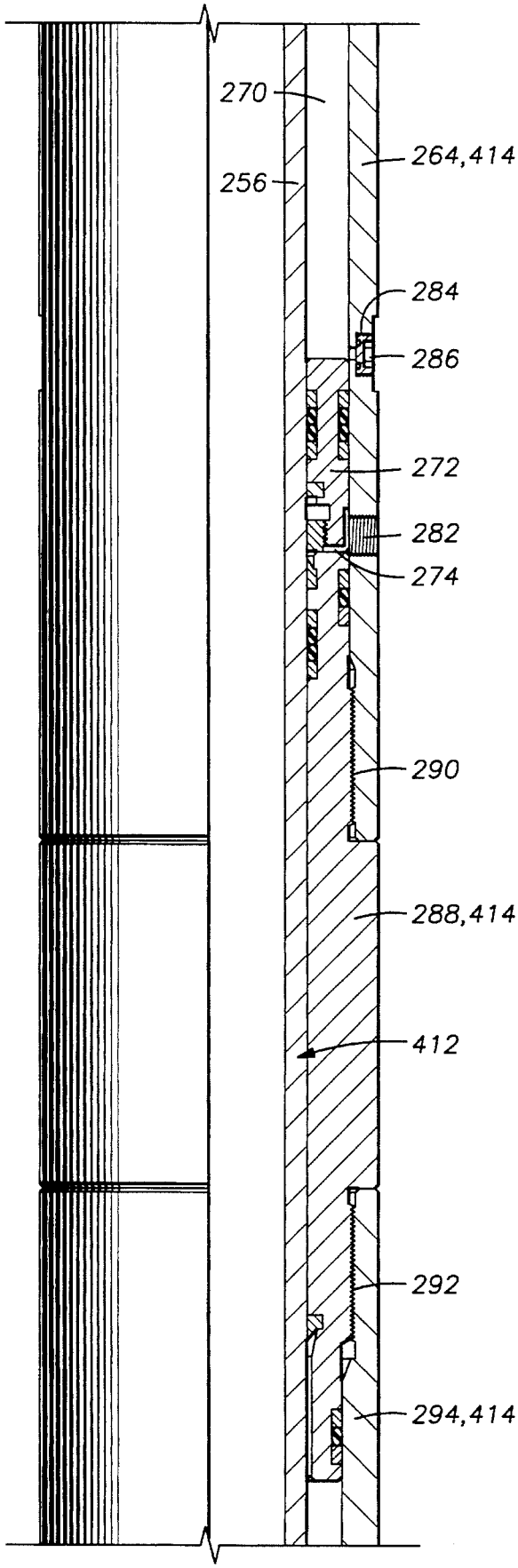
Figure 3H:
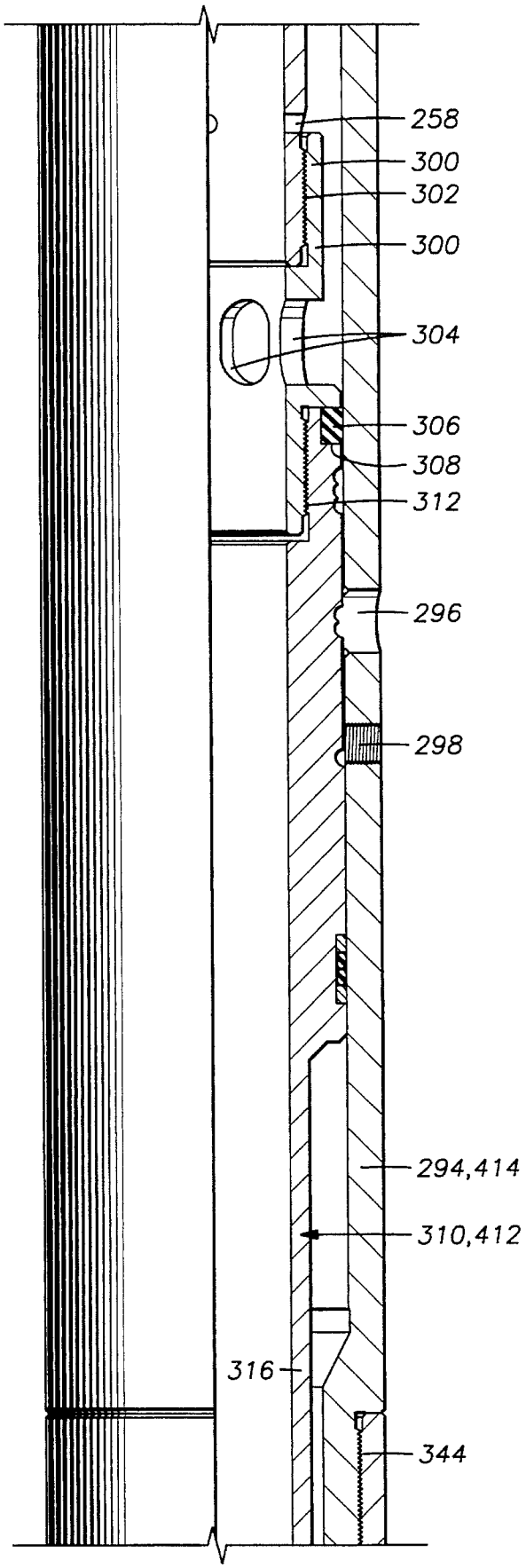
Figure 3I:
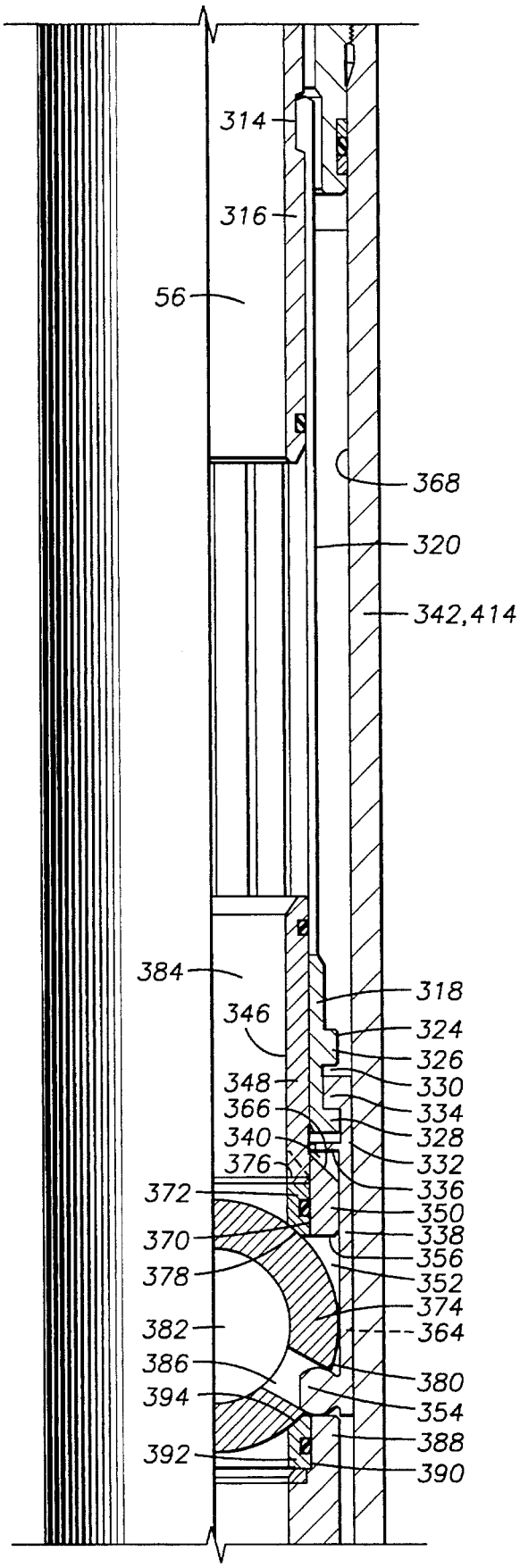
Figure 3J:
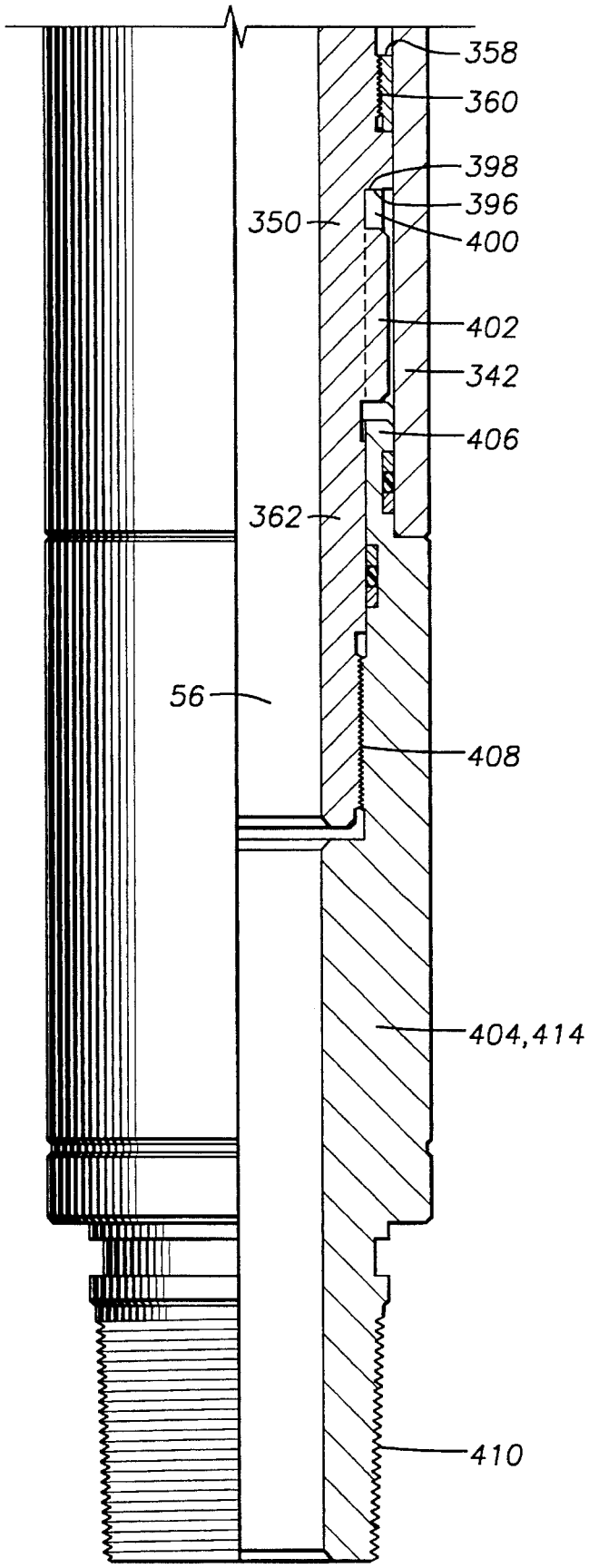
Figure 4A:
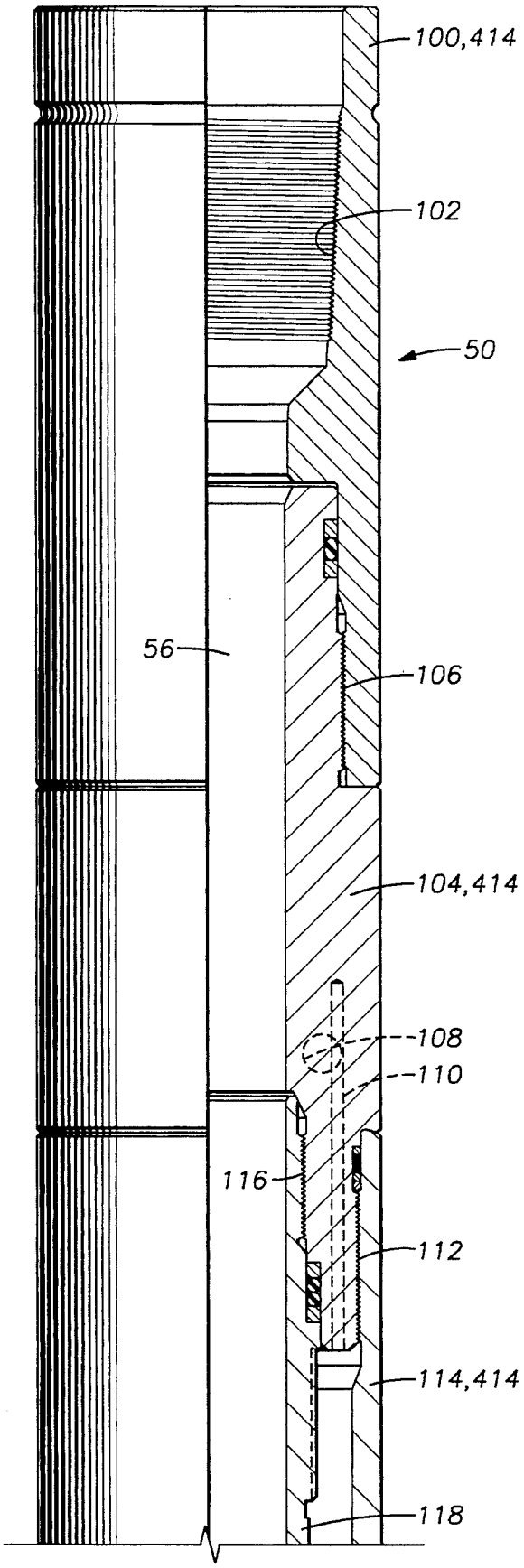
FIGS. 4A–4J are a vertical half-section of the tool of FIG. 2 in a fluid circulation mode.
Figure 4B:
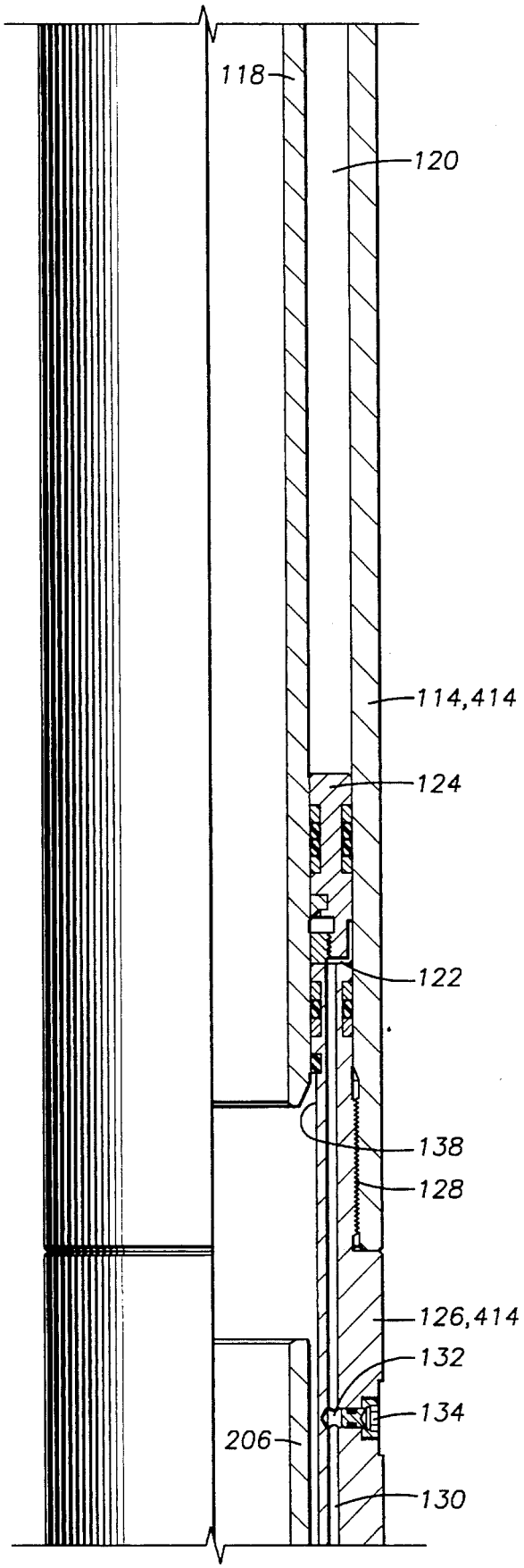
Figure 4C:
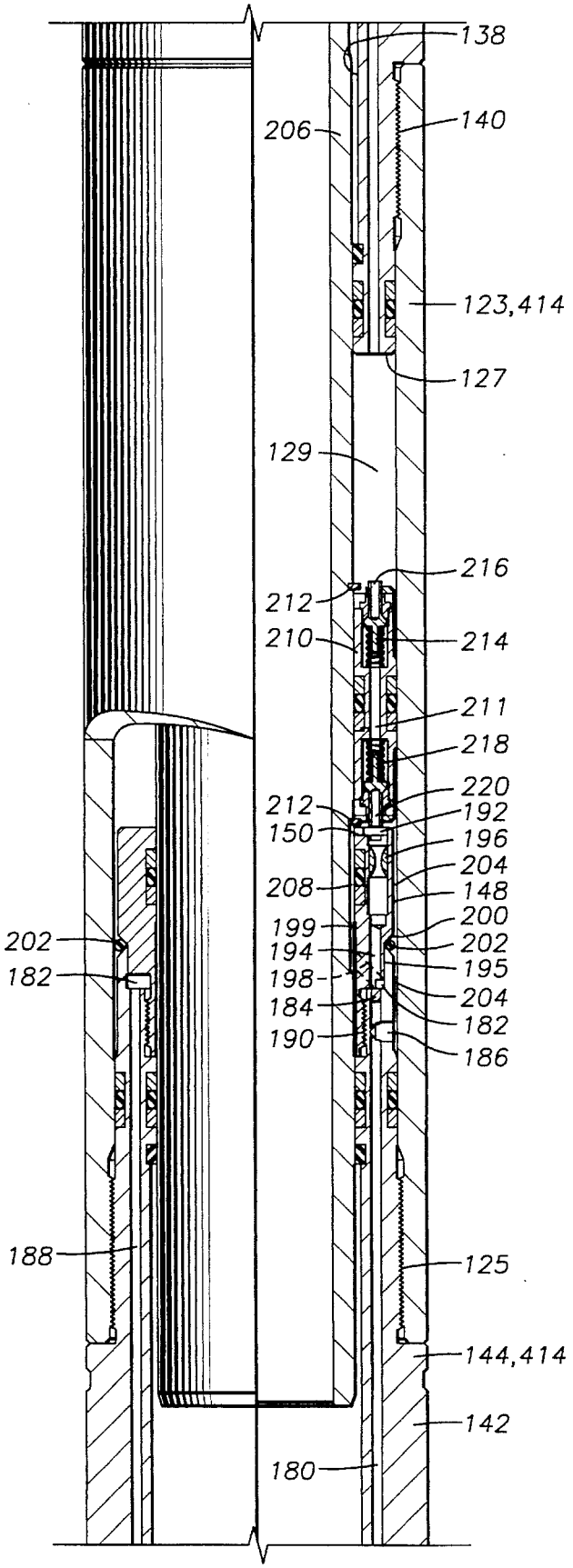
Figure 4D:
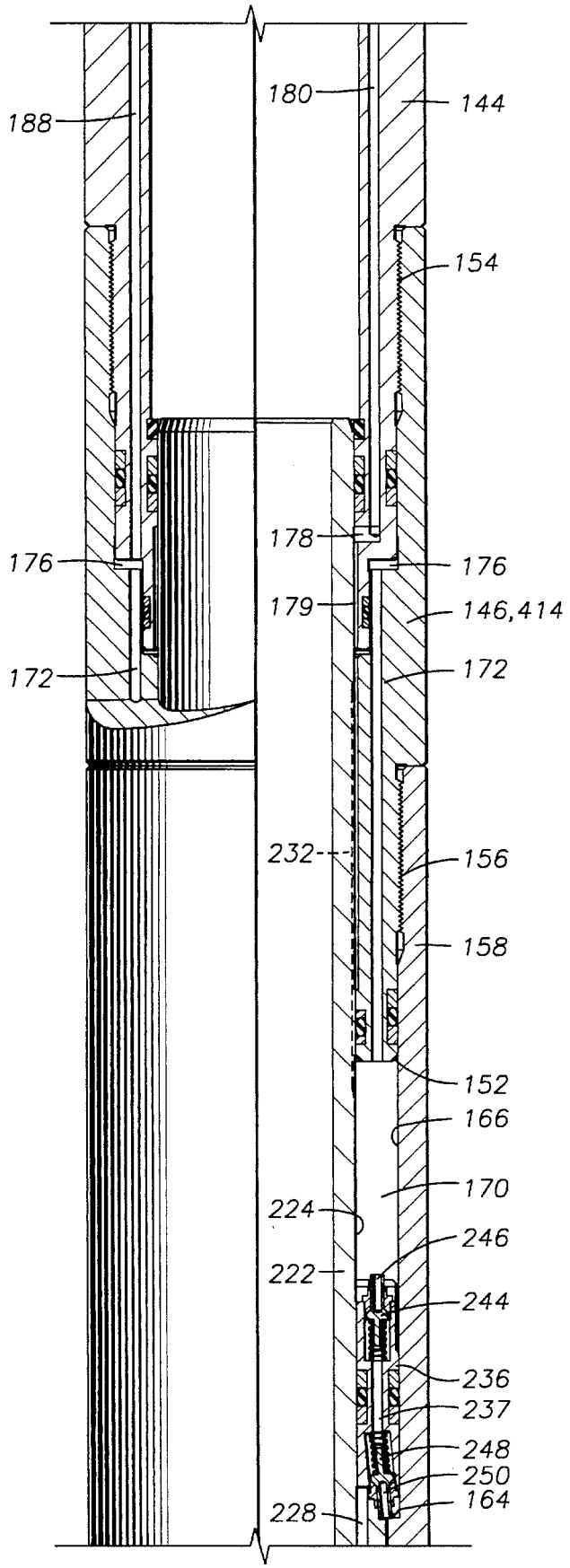
Figure 4E:
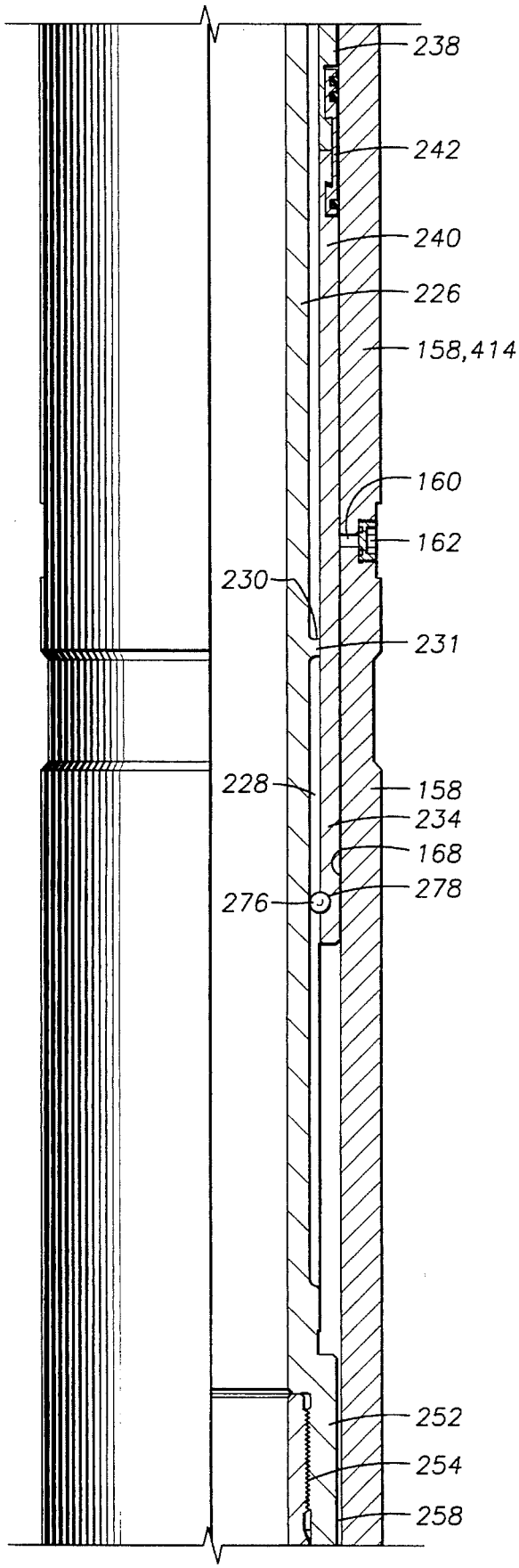
Figure 4F:
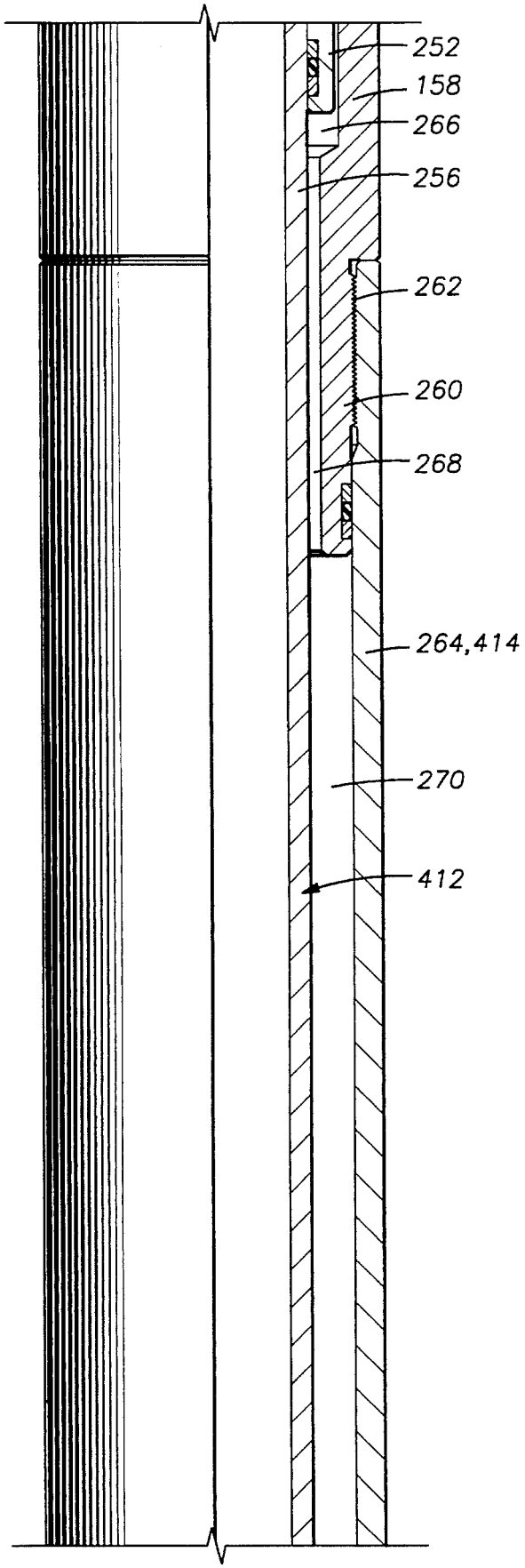
Figure 4G:
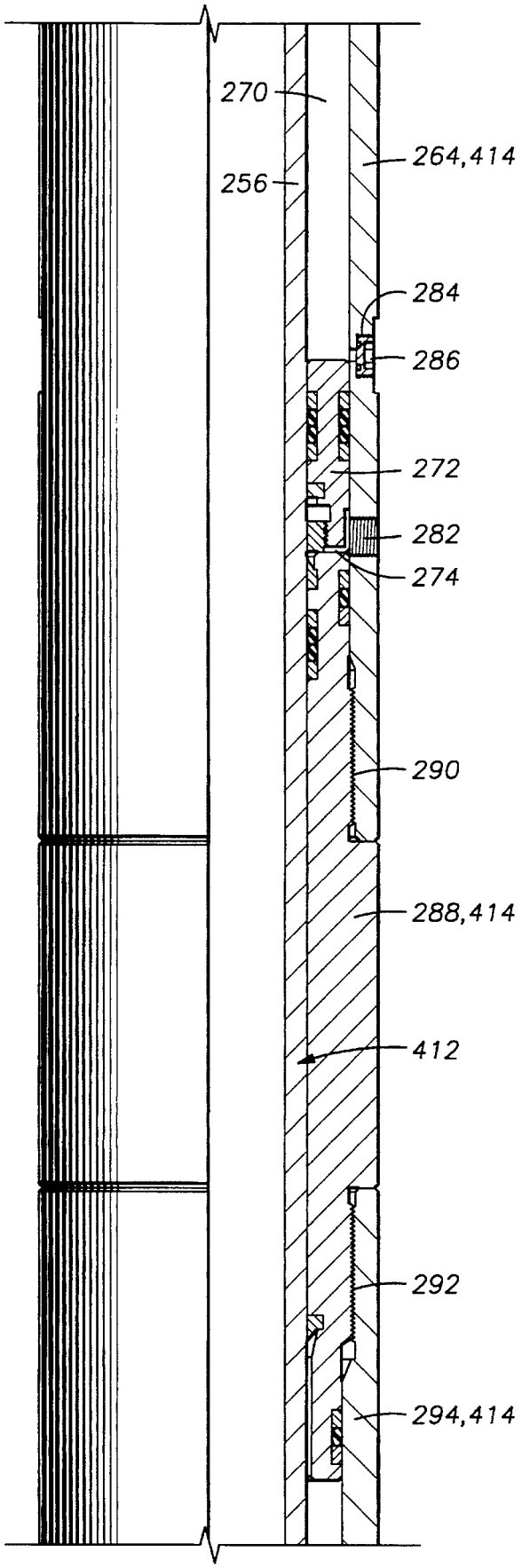
Figure 4H:
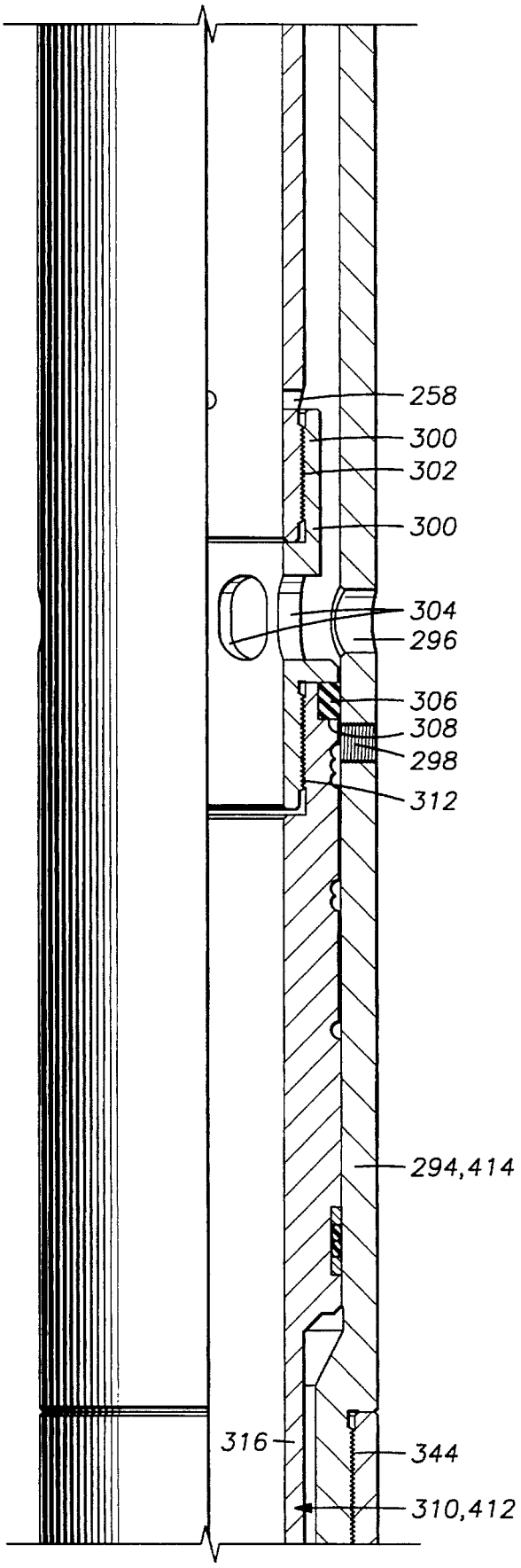
Figure 4I:
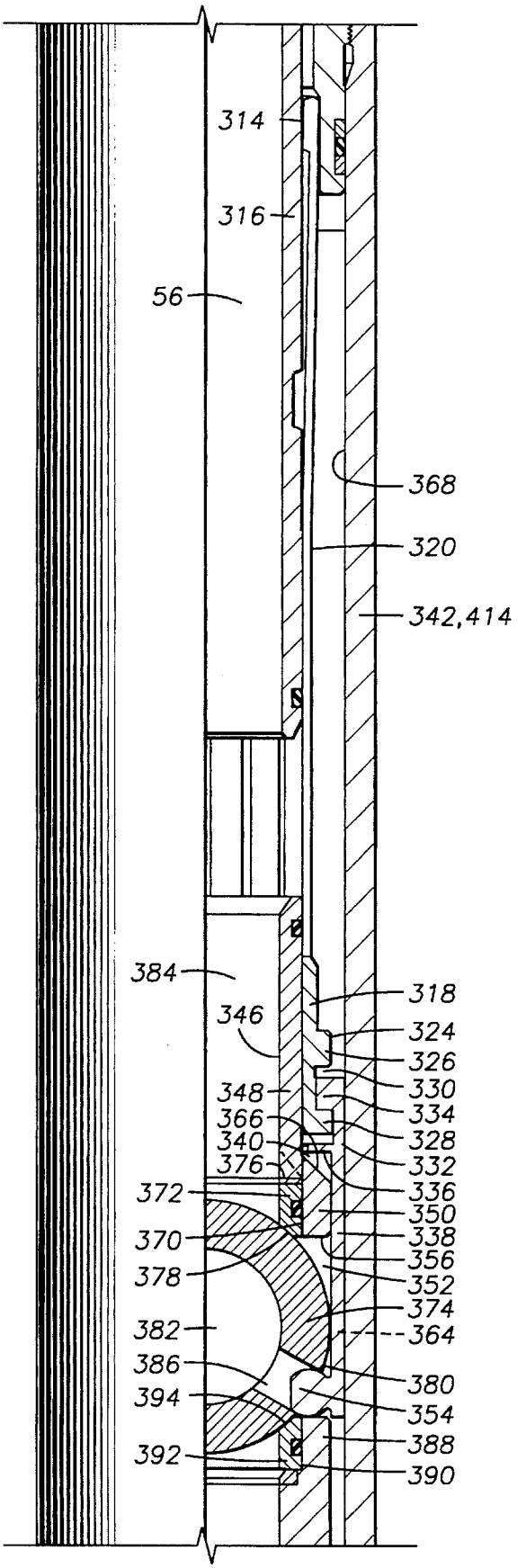
Figure 4J:
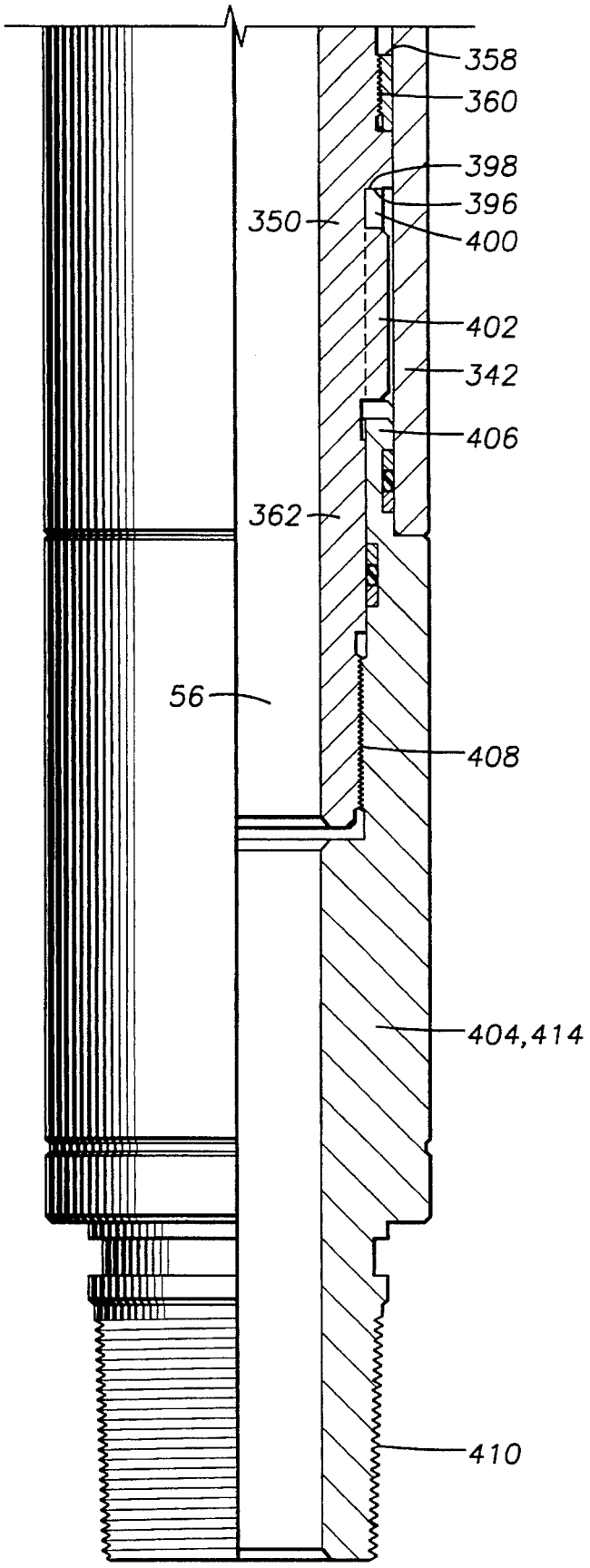

A bypass mechanism is included in tool 50 which shortens the length of time needed for selected portions of the metered downstroke to be completed. The bypass mechanism employs the upper and lower bypass grooves 208 and 232 to selectively permit fluid to bypass portions of the fluid metering assembly at specific points during the downstroke to shorten the downstroke. As the annular piston 210 and affixed bypass mandrel 206 are moved downward sufficiently, portions of the lengths of upper bypass grooves 208 are disposed below the upper end 150 and adjacent the clearance 199 and lateral hole 198 of fluid metering assembly 142. As shown in FIGS. 3C and 4C, fluid communication occurs between the fluid chamber 129 and the upper annular gap 182. The bypass assembly thereby permits fluid from the fluid chamber 129 to bypass the fluid restrictor 196 and move into the second passage 188 of the upper fluid flow housing 144 where it may be readily transmitted downward into the ratchet chamber 170. The downward flow of fluid is thereby increased speeding up the downward stroke. By choice of width and length of the upper bypass grooves 208 as well as the placement upon the bypass mandrel 206, the amount and timing of fluid bypassing may be controlled.

The lower bypass grooves 232, which are located on the upper exterior 224 of the ratchet slot mandrel 222, are placed such that, when the mandrel 222 is in an upper position, such as in the well test position, the grooves 232 are generally adjacent the annular chamber 179 and no fluid flow occurs therealong. See FIG. 2D. As the mandrel 222 moves downward with respect to the housing 414, the lower portion of grooves 232 are moved adjacent the ratchet chamber 170 and fluid communication is permitted between the annular chamber 179 and ratchet chamber 170.

When the well bore annulus is repressured to move the tool 50 out of its well test position, the ball sleeve assembly 234 moves upward and balls 276 are moved along slot 228 from proximate ball position c to a point above ball position $d_1$. The balls 276 have now been directed out of the well test position cycle shown at 283 on FIG. 5 and into a contiguous second ratchet path made up of the remainder of slot 281 to permit the operating mandrel assembly 412 to move to alternate mandrel positions wherein the positions of the valve ball 374 and circulating assembly 416 may be changed. Upward travel of the ball sleeve assembly 234 is ultimately limited as shuttle piston 236 encounters the lower end 152 of the fluid metering assembly 142. Downward force is exerted upon the dart 246 permitting upward fluid flow past the check valve 244 and a subsequent reduction in the upward pressure differential upon the ball sleeve assembly 234. As the pressure differential is reduced, balls 276 are shouldered at ball position $d_1$.

Once the balls 276 have been located at ball position $d_1$, further reduction of the annulus pressure shifts the tool 50 into its blank position as illustrated by FIG. 3 with the valve ball 374 being moved to a closed position. The operating mandrel assembly 412 is positioned lower with respect to the ball sleeve assembly and housing 414 due to engagement of the balls 276 with the ratchet slot mandrel 222 at ball position $d_1$. The downward pressure differential upon ball sleeve assembly 234 urges it downward along with the operating mandrel assembly 412, collet sleeve 318 and ball operating arms 338 to close valve ball 374 such that its bore 382 is not aligned with the ball housing bore 384. As is apparent from FIG. 3H, however, this downward movement is not sufficient to align the circulation ports 296 with the valve apertures 304 and permit fluid communication therethrough. As a result, the circulating assembly 416 remains closed.

During a subsequent well annulus pressure increase and decrease cycle, balls 276 are moved along slot 228 to ball position $e_1$. This will have the effect of moving the operating mandrel assembly 412 further downward with respect to the exterior housing 414. However, the fluid circulating assembly 416 remains closed. To prevent damage to the valve ball 374 and its surrounding parts as a result of excessive downward movement of the operating mandrel assembly 412, protuberances 322 may become disengaged from recess 314 as shown in FIG. 41.

As well annulus pressure is increased and decreased once more, the balls 276 are moved from ball position $e_1$ to position $f_1$ causing the tool 50 to be moved into its circulating position. In this position, as shown in FIG. 4, the valve ball 374 remains closed and the fluid circulating assembly 416 is opened by the alignment of the circulation ports 296 and valve apertures 304 to permit fluid communication between the central flow conducting passage 56 and the well bore annulus 46. The tool 50 will remain in the circulating position during subsequent annulus pressure change cycles where the balls 276 are moved sequentially to positions $f_2$, $f_3$, $f_4$, $f_5$, $f_6$ and $f_7$.

By way of further explanation of the mode changing and operating sequence of tool 50, the reader should note that the tool only changes mode when balls 276 shoulder at specific positions on slot 228 during cycling of the tool since ratchet operation dictates the position of the operating mandrel assembly 412 within the housing 414. For example, tool 50 changes mode at positions $d_1$, $f_1$, $f_7$ and $d_2$.

It is also noted that movement between some ball positions is effected by annulus pressure decrease followed by an increase rather than the increase/decrease cycle described above. With respect to FIG. 5, specifically, movement from $f_6$ to $f_7$, from $f_7$ to $e_2$ and from $e_2$ to $d_2$ is accomplished this way.

The present invention is described with respect to preferred embodiments, but is not limited to those described. For example, the ratchet slot 228 design may be altered to feature different test positions. Alternatively, the tool 50 might be programmed to effect modes of operation other than those disclosed with respect to the preferred embodiments described herein. It will be readily apparent to one of ordinary skill in the art that numerous such modifications may be made to the invention without departing from the spirit and scope of it as claimed.

What is claimed is:

1. A tool for use in a testing string in a well bore, comprising:

a. an exterior housing defining a central flow conducting passage;

b. an operating element with the exterior housing operable between two positions, a first position wherein the flow conducting passage through said tool is blocked, and a second position, wherein the flow conducting passage is not blocked;

c. a fluid circulating assembly within the exterior housing operable between two positions, a first wherein fluid is communicated between an external well bore annulus and the central flow conducting passage, and a second wherein fluid communication between an external well bore annulus and the central flow conducting passage is blocked;

d. an operating mandrel assembly slidably disposed within the exterior housing and operably associated with the operating element and the fluid circulating assembly, the operating mandrel assembly being responsive to variations in annulus pressure to move between a number of mandrel positions each of which correspond to preset positions for the operating element and for the fluid circulating assembly to configure the tool into distinct operative modes;

e. an overrideable position controller to dictate response of the operating mandrel assembly to variations in annulus pressure, the position controller providing a default position sequence wherein the operating mandrel assembly is maintained in primary mandrel positions during annulus pressure changes, said position controller being overrideable to permit selective movement of the operating mandrel assembly into alternate mandrel positions.

2. The tool of claim 1 wherein the overrideable position controller comprises a ratchet assembly interrelating the operating mandrel assembly and the exterior housing, the ratchet assembly comprising a ratchet path and a ratchet member which is movably received in and directable within the ratchet path.

3. The tool of claim 2 wherein the default position sequence of the position controller is provided by a first cyclical ratchet path within which the ratchet member is directed to maintain the operating mandrel assembly in its primary mandrel positions.

4. The tool of claim 3 wherein the position controller is overrideable by directing the ratchet member outside the first cyclical ratchet path and into a contiguous second ratchet path to move the operating mandrel assembly to alternate mandrel positions.

5. The tool of claim 4 wherein responsiveness of the operating mandrel assembly to annulus pressure changes is effected by a pressure conducting channel within the exterior housing, the pressure conducting channel including a fluid spring to store increases in fluid pressure within the channel and release the stored pressure increases into the channel upon a decrease in annulus pressure, and a pressure passageway in fluid communication with an external wellbore annulus and the fluid spring.

6. The tool of claim 5 wherein the position controller is overrideable by directing the ratchet member into the second ratchet path during a change in stored fluid pressure of the fluid spring along the pressure passageway.

7. The tool of claim 6 wherein the ratchet member is directed into the second ratchet path upon a change in annulus pressure occurring during a change of stored pressure in the fluid spring.

8. The tool of claim 5 wherein the pressure conducting channel further comprises a fluid metering assembly within the pressure passageway which provides substantially unrestricted transmission of fluid pressure along the pressure passageway during an increase in fluid pressure in the fluid spring and metered transmission of fluid pressure along the pressure passageway during a release of fluid pressure from the fluid spring.

9. The tool of claim 8 wherein the fluid metering assembly includes a first flow path which provides substantially unrestricted fluid flow therethrough and a second flow path containing a fluid restrictor to provide restricted fluid flow through the flow path.

10. The tool of claim 8 further comprising a bypass assembly which selectively shortens the time required for metered transmission of fluid pressure along the pressure passageway during the second change in pressure in the fluid spring.

11. The tool of claim 10 wherein the bypass assembly comprises a fluid communication groove inscribed upon the exterior of the operating mandrel assembly, the fluid communication groove operable to selectively increase fluid flow across the fluid metering assembly during transmission of fluid pressure along the pressure passageway.

12. The tool of claim 10 wherein the bypass assembly comprises a bypass mandrel slidably disposed with the exterior housing, and a fluid communication groove inscribed upon the exterior of the bypass mandrel and operable to selectively cause fluid flow to bypass the fluid restrictor of the second flow path.

13. A method of operating a testing string tool comprising the steps of:

a. providing a tool for use in a testing string disposed in a well bore, the tool comprising:

1) an exterior housing defining a central flow conducting passage;

2) an operating element within the exterior housing operable between two positions, a first position wherein the flow conducting passage through said tool is blocked, and a second position, wherein the flow conducting passage is not blocked;

3) a fluid circulating assembly within the housing operable between two positions, a first position wherein fluid is communicated between an external well bore annulus and the central flow conducting passage, and a second position wherein fluid communication between an external well bore annulus and the central flow conducting passage is blocked;

4) an operating mandrel assembly slidably disposed within the exterior housing and operably associated with the operating element and the fluid circulating assembly, the operating mandrel assembly being responsive to variations in annulus pressure to move between a number of mandrel positions each of which correspond to preset positions for the operating element and for the fluid circulating assembly to configure the tool into distinct operative modes;

5) a pressure conducting channel within the housing for effecting responsiveness of the operating mandrel assembly to annulus pressure changes, the pressure conducting channel comprising a fluid spring to store increases in fluid pressure within the channel and release the store pressure increases into a channel upon a decrease in annulus pressure, and, a pressure passageway in fluid communication with an external wellbore annulus and the fluid spring;

6) an overrideable position controller to dictate response of the operating mandrel assembly to variations in annulus pressure, the position controller comprising a ratchet assembly interrelating the operating mandrel assembly and the exterior housing, the ratchet assembly comprising a ratchet path and a ratchet member which is movably received in and directable within the ratchet path providing a default position sequence provided by a first, cyclical ratchet path within which the ratchet member is directed to maintain the operating mandrel assembly in its primary mandrel positions during annulus pressure changes, said position controller being overrideable to permit selective movement of the operating mandrel assembly into alternate mandrel positions;

b. configuring the tool into a well test mode in which the operating element is in its second position and the circulating assembly is in its second position;

c. operating said tool such that the ratchet member is maintained within the primary ratchet path by increasing annulus pressure, storing the increase within the fluid spring and releasing the stored pressure;

d. redirecting said ratchet member into the second ratchet path by increasing annulus pressure during the release of stored pressure.

14. The method of claim 13 wherein redirection of the ratchet member into the second path permits the tool to be reconfigured into an alternative operating mode.

15. The method of claim 14 wherein the alternative operating mode comprises a blank configuration in which the operating element is in its first position and the circulating assembly is second position.

16. The method of claim 14 wherein the alternative operating mode comprises a circulating configuration in which the operating element is in its first position and the circulating assembly is in its first position.

17. An apparatus disposed in a pipe string suspended within a casing string in a well bore, the pipe string and casing string forming an annulus therebetween, comprising;

a cylindrical housing having a flow bore therethrough and at least one flow port in a wall of said housing communicating with the annulus;

a valve disposed in said cylindrical housing having an open position allowing fluid flow through said flow bore and a dosed position preventing fluid flow through said flow bore;

a mandrel reciprocally disposed within said cylindrical housing and operatively connected to said valve for moving said valve between said open and closed positions;

said mandrel having at least one flow aperture through a wall thereof and having a circulating position where said flow aperture is in fluid communication with said flow port for fluid communication between the annulus and said flow bore and a non-circulating position where said flow aperture is not in fluid communication with said flow port;

said mandrel having a ratchet groove in which is disposed at least one ball rotatably mounted on said cylindrical housing, said mandrel being exposed to the fluid pressure in the annulus through said flow port whereby an increase in annulus pressure causes said mandrel to move upwardly with respect to said cylindrical housing with said ball riding in said ratchet groove;

said mandrel and said cylindrical housing forming a pressure chamber having a piston with an end subjected to the annulus pressure whereby said pressure chamber is charged upon an increase in annulus pressure such that upon a decrease in annulus pressure, said pressure chamber causes said mandrel to move downwardly with respect to said cylindrical housing with said ball riding in said ratchet groove;

said ratchet groove forming a circular path, a cyclical path, and tow generally straight paths connecting said circular and cyclical paths;

said valve being in said open position and said flow port being in said non-circulating position when said ball is traveling in said circular path;

said valve being in said closed position and said flow port being in said non-circulating position when said ball is traveling in said straight paths; and, said valve being in said closed position and said flow port being in said circulating position when said ball is traveling in said cyclical path.

18. The apparatus of claim 17 further including means for moving said ball out of said circular path by decreasing and then increasing said annulus pressure.

19. The apparatus of claim 17 wherein said housing includes first and second unrestricted fluid channels between said flow port and a first side of said pressure chamber and a third restrict fluid channel between said flow port and said first side of said pressure chamber.

20. The apparatus of claim 19 wherein fluid travels through said first unrestricted fluid channel upon increasing said annulus pressure and through said second unrestricted fluid channel upon decreasing said annulus pressure except that the fluid passes through said third restricted fluid channel to move said ball out of said circular path.

* * * * *